US010382873B2

(12) United States Patent
Abe et al.

(10) Patent No.: US 10,382,873 B2
(45) Date of Patent: Aug. 13, 2019

(54) COMMUNICATION APPARATUS, WIRELESS MICROPHONE SYSTEM AND COMMUNICATION METHOD

(71) Applicant: PANASONIC INTELLECTUAL PROPERTY MANAGEMENT CO., LTD., Osaka (JP)

(72) Inventors: Katsuya Abe, Fukuoka (JP); Katsumi Nakagawa, Fukuoka (JP); Hisayuki Sasaki, Fukuoka (JP); Ryosuke Kitago, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/204,516

(22) Filed: Nov. 29, 2018

(65) Prior Publication Data

US 2019/0200149 A1 Jun. 27, 2019

(30) Foreign Application Priority Data

Dec. 27, 2017 (JP) ..... 2017-251760

(51) Int. Cl.

*H04R 29/00* (2006.01)
*H04R 1/40* (2006.01)
*H04R 3/00* (2006.01)

(52) U.S. Cl.

CPC ..... *H04R 29/006* (2013.01); *H04R 1/406* (2013.01); *H04R 3/005* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 5,793,757 | A | 8/1998 | Uddenfeldt | |
| 6,563,806 | B1 | 5/2003 | Yano et al. | |
| 2008/0247336 | A1 * | 10/2008 | Sugitani ..... | H04B 7/2643 370/280 |
| 2015/0063604 | A1 | 3/2015 | Ohbuchi et al. | |

FOREIGN PATENT DOCUMENTS

| | | |
|---|---|---|
| JP | 11-004129 | 1/1999 |
| JP | 11-262044 | 9/1999 |
| JP | 2000-504908 | 4/2000 |
| JP | 2002-141880 | 5/2002 |
| JP | 2015-019146 | 1/2015 |
| JP | 2015-050727 | 3/2015 |

* cited by examiner

*Primary Examiner* — Paul W Huber

(74) *Attorney, Agent, or Firm* — Greenblum & Bernstein, P.L.C.

(57) ABSTRACT

In a wireless microphone system, a master device includes a master device control unit that generates a communication table in which a pair of a carrier wave and a slot which are used for communication with m microphone slave devices are set for one frame period, based on a total number of six carrier waves in a DECT system and n slots constituting one frame period of the DECT system, and k wireless processing units that perform communication using the DECT system with corresponding individual microphone slave devices among m microphone slave devices, based on the generated communication table. The k wireless processing units respectively operate synchronously based on the same clock signal.

12 Claims, 18 Drawing Sheets

FIG. 7

100

| SLOT / CARRIER | S0 | S1 | S2 | S3 | S4 | S5 | S6 | S7 | S8 | S9 | S10 | S11 |
|---|---|---|---|---|---|---|---|---|---|---|---|---|
| f1 | | WU2 2C5 | WU5 2C13 | FOR SWITCHING | | | | | FOR SWITCHING | | | FOR SWITCHING |
| ⋮ | | ⋮ | ⋮ | ⋮ | ⋮ | ⋮ | ⋮ | ⋮ | ⋮ | ⋮ | ⋮ | ⋮ |
| f6 | FOR SWITCHING | | | | | | FOR SWITCHING | | WU3 2C8 | | | FOR SWITCHING |

COMMUNICATION APPARATUS, WIRELESS MICROPHONE SYSTEM AND COMMUNICATION METHOD

BACKGROUND OF THE INVENTION

1. Field of the Invention

The present disclosure relates to a communication apparatus, a wireless microphone system, and a communication method, for receiving a voice signal transmitted from each of a plurality of microphones, using time division multiplex communication.

2. Description of the Related Art

In the related art, a wireless microphone system has been known which transmits a voice signal picked up by a microphone, by wireless communication. The wireless microphone system includes a plurality of microphone slave devices, and a master device that receives a voice signal transmitted from each of the microphone slave devices, through a communication channel established between each of the microphone slave devices and the master device. The master device has a speaker, and outputs the voice signals picked up by each of the microphone slave devices from the speaker. Since such a wireless microphone system can flexibly adapt to the usage environment, it is widely used in facilities such as school classrooms, hotel banquet halls, and the like.

JP-A-2015-50727 discloses a wireless communication system including one master device and a plurality of microphone slave devices, in which the master device performs wireless communication with each of the microphone slave devices in a time division multiplex communication system. In the wireless communication system, in order to suppress radio interference to other wireless communication systems, the master device suppresses the transmission power for the distant microphone slave device to the extent that communication can be maintained.

However, in the configuration of JP-A-2015-50727, the master device is not able to establish communication channels of a default number of multiplexing or more determined by the communication standard of wireless communication, used between each microphone slave device and the master device, in a case of performing wireless communication by the time division multiplex communication system. For example, in a case where the communication standard of wireless communication is a digital enhanced cordless telecommunications (DECT) system, communication channels cannot be established more than the number of default slots (time slots) constituting one frame period. In other words, the number of communication channels allocated for communication with each microphone slave device does not become equal to or larger than the default number of slots constituting one frame period, and the number of microphone slave devices with which the master device can communicate in one frame period is limited. Therefore, the amount of the voice signals transmitted from the microphone slave device to the master device is limited, and it is difficult for the master to output a high-quality voice signal.

SUMMARY OF THE INVENTION

The present disclosure has been devised in view of the above-described circumstances in the related art, and an object thereof is to provide a communication apparatus, a wireless microphone system, and a communication method, in which in a communication system relating to communication performed with microphones which are communication partners, after multiplexing with microphones of the number equal to or larger than a default number of slots constituting one frame period is allowed, communication is performed with each of the microphones, and a voice signal with good voice quality is output.

The present disclosure provides a communication apparatus including a controller that generates a table in which a carrier wave and a slot to be used for communication with each of m (m: an integer of 2 or more) microphones are set for each one frame period, based on a default number of carrier waves based on a time division multiplex communication system and n (n: a default positive integer) slots constituting the one frame period of the time division multiplex communication system; and k (k: an integer of 2 or more) wireless processing units that perform communication using the time division multiplex communication system with corresponding individual microphones among the m microphones, based on the generated table, the k wireless processing units respectively operate synchronously based on the same clock signal, and the number C of communicable channels of them microphones is $C>k*\{(n/2)-1\}$.

Further, the present disclosure provides a wireless microphone system including a master device; and m (m: an integer of 2 or more) microphones, which are connected to each other for communication, in which the master device includes a controller that generates a table in which a carrier wave and a slot to be used for communication with each of the m microphones are set for each one frame period, based on a default number of carrier waves based on a time division multiplex communication system and n (n: a default positive integer) slots constituting the one frame period of the time division multiplex communication system; and k (k: an integer of 2 or more) wireless processing units that perform communication using the time division multiplex communication system with corresponding individual microphones among the m microphones, based on the generated table, the k wireless processing units respectively operate synchronously based on the same clock signal, and the number C of communicable channels of the m microphones is $C>k*\{(n/2)-1\}$.

Further, the present disclosure provides a communication method using a communication apparatus connected to m (m: an integer of 2 or more) microphones for communication, the method including a step of generating a table in which a carrier wave and a slot to be used for communication with each of the m microphones, is set for each one frame period, based on a default number of carrier waves based on a time division multiplex communication system and n (n: a default positive integer) slots constituting the one frame period of the time division multiplex communication system; and a step of performing communication using the time division multiplex communication system with corresponding individual microphones among the m microphones, based on the generated table, by k (k: an integer of 2 or more) wireless processing units included in the communication apparatus, the step of performing communication by the k wireless processing units has steps of respectively and synchronously operating based on the same clock signal, and the number C of communicable channels of the m microphones is $C>k*\{(n/2)-1\}$.

According to the present disclosure, in a communication system relating to communication performed with microphones which are communication partners, after multiplexing with microphones of the number equal to or larger than a default number of slots constituting one frame period is allowed, communication is performed with each of the microphones, so it is possible to output a voice signal with good voice quality.

BRIEF DESCRIPTION OF DRAWINGS

FIG. 7 is a diagram showing an example of registered contents of a communication table showing a communication channel set for each carrier and each slot.

DETAILED DESCRIPTION OF THE EXEMPLARY EMBODIMENT

Hereinafter, each embodiment specifically disclosing a communication apparatus, a wireless microphone system and a communication method according to the present disclosure will be described in detail with reference to the accompanying drawings as appropriate. However, detailed description more than necessary may be omitted. For example, detailed explanations of already well-known matters and redundant explanation of substantially the same configuration may be omitted. This is to avoid the following description from being unnecessarily redundant and to facilitate the understanding of those skilled in the art. In addition, the accompanying drawings and the following description are provided in order to help those skilled in the art fully understand the present disclosure and are not intended to limit the subject described in claims.

The wireless microphone system according to each embodiment includes a plurality of microphone slave devices, and a master device that receives voice signals picked up by each of the plurality of microphone slave devices. In addition, in the wireless microphone system according to each embodiment, the master device multiplexes the picked-up voice signals, between each of the plurality of microphone slave devices and the master device, by using, for example, a time division multiple access (TDMA) system and performs wireless communication.

Embodiment 1

Figure 1:
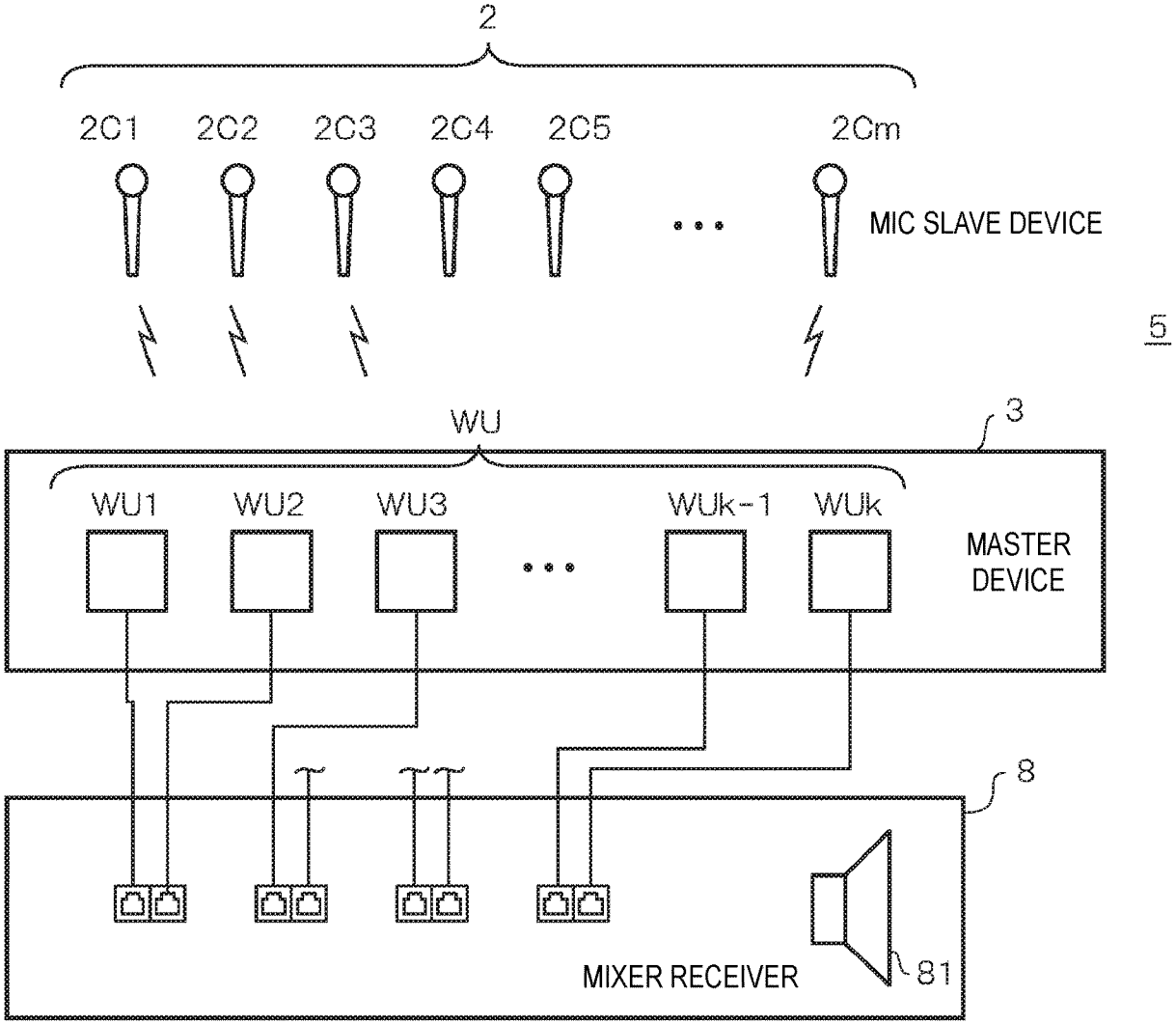
FIG. 1 is a diagram schematically showing a system configuration example of a wireless microphone system according to Embodiment 1.

FIG. 1 is a diagram schematically showing a system configuration example of a wireless microphone system 5 according to Embodiment 1. The wireless microphone system 5 includes a plurality of (for example, m) microphone slave devices 2, a master device 3 as an example of a receiver, and a mixer receiver 8. M is an integer of 2 or more. In the following description, each of a plurality of microphone slave devices 2C1, 2C2, . . . , and 2Cm is referred to as a microphone slave device 2 unless otherwise distinguished.

A wireless signal (for example, a voice signal or a control signal) is transmitted and received between the microphone slave device 2 and the master device 3 through a wireless line conforming to the communication standard of a time division multiple access system (for example, a time division multiplex communication system). When the user of the microphone slave device 2 inputs a voice (for example, issues a voice) to the microphone slave device 2, the voice signal picked up by the microphone slave device 2 is transmitted to the master device 3 through a wireless line. In each embodiment, Digital Enhanced Cordless Telecommunications (DECT) system with a frequency band of 1.9 GHz which is the standard of a digital cordless telephone established in 2011, for example, is used as the communication standard of time division multiplex communication system.

The master device 3 has a plurality of (for example, k) wireless processing units WU1, WU2, . . . , and WUk capable of receiving voice signals from the microphone slave devices 2, respectively. k is an integer of 2 or more. The plurality of wireless processing units WU1 to WUk is referred to as a wireless processing unit WU unless otherwise distinguished. Details of the wireless processing unit WU will be described later. Based on the voice signal received by the wireless processing unit WU, the master device 3 outputs and plays the voice by the speaker 29 (see FIG. 5) and also outputs the voice to the mixer receiver 8. The mixer receiver 8 synthesizes one or more voice signals input from the master device 3 and outputs the voice signal after voice synthesis from the built-in speaker 81.

Figure 2:
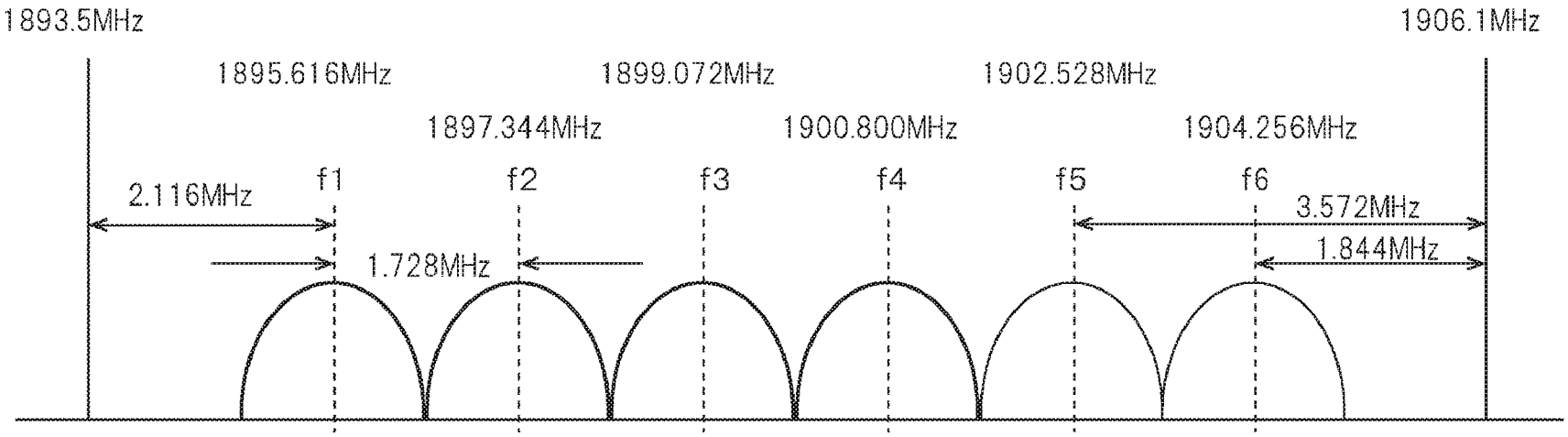
FIG. 2 is a diagram for explaining a frequency band of carriers used in DECT communication.

FIG. 2 is a diagram for explaining a frequency band of a carrier used in DECT-system communication. In the DECT-system communication, five frequency bands are used in the 1.9 GHz band (specifically, 1895.616 MHz to 1902.528 MHz). Specifically, the five frequency bands are carriers (that is, carrier waves. The same applies hereinafter.) having a center frequency of f1 (1895.616 MHz), a carrier having a center frequency of f2 (1897.344 MHz), a carrier having a center frequency of f3 (1899.072 MHz), a carrier having a center frequency of f4 (1900.800 MHz), a carrier having a center frequency of f5 (1902.528 MHz), and a carrier having a center frequency of f6 (1904.256 MHz).

Since these frequency bands do not overlap, radio interference hardly occurs, and communication trouble can be reduced. In addition, since the DECT communication using the 1.9 GHz band does not interfere with radio waves emitted from a wireless local area network (LAN) and devices such as a microwave oven, the voice quality of the wireless microphone system can be maintained. In addition, the master device 3 constantly monitors the usage status of the channel of each frequency band (for example, the availability of resources such as carriers and slots) in each frame period of the DECT communication and selects the channel of the optimum frequency band, so the 1.9 GHz band can be used efficiently.

Figure 3:
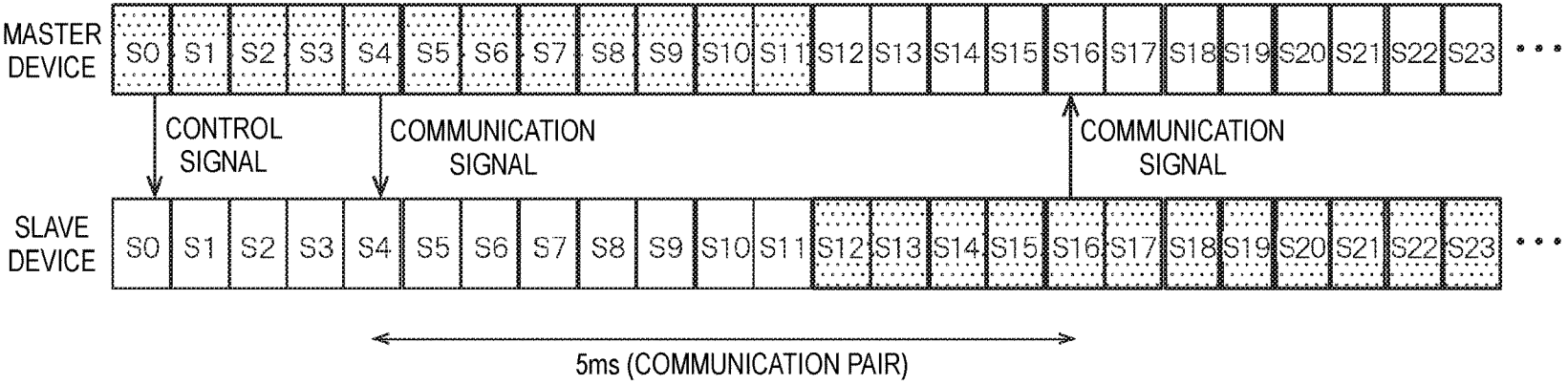
FIG. 3 is a diagram showing time slots in which wireless signals are transmitted and received between a master device and a microphone slave device.
Figure 4:
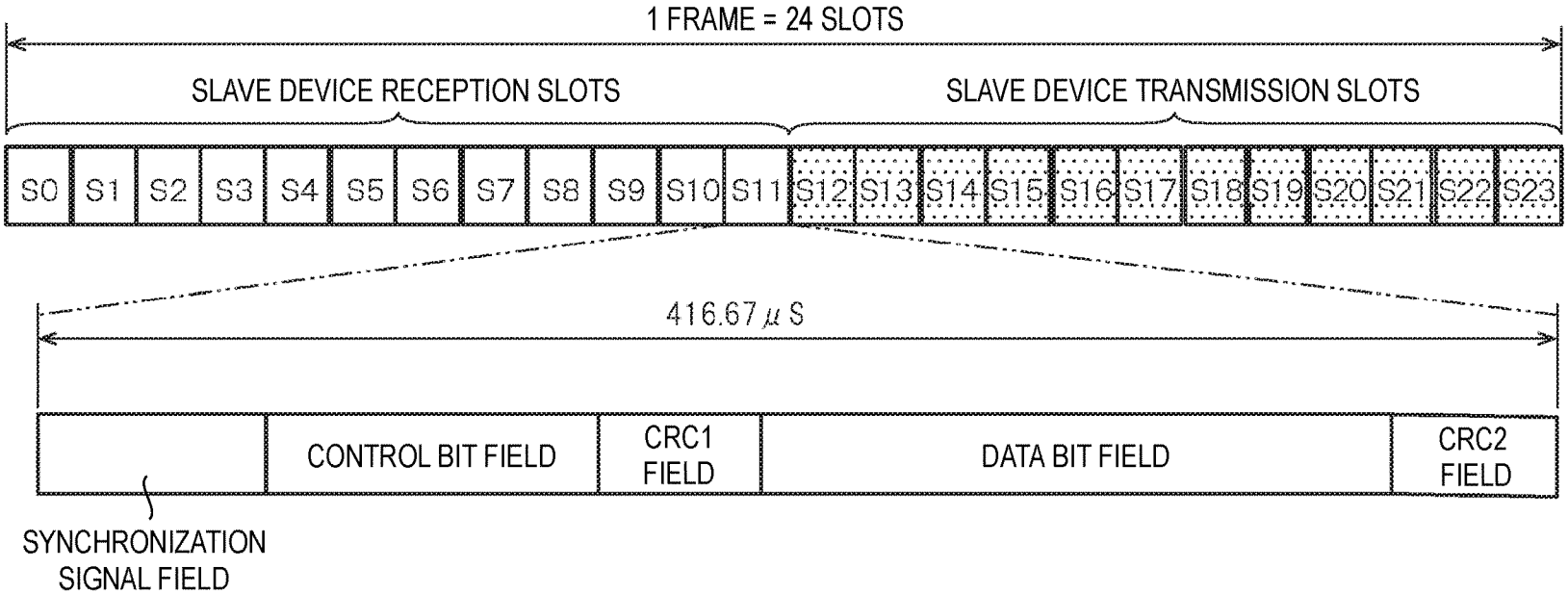
FIG. 4 is a diagram showing a frame configuration of a signal in the DECT communication.

FIG. 3 is a diagram showing time slots in which wireless signals are transmitted and received between the master device 3 and a microphone slave device 2. Hereinafter, time slots are abbreviated as "slots". FIG. 4 is a diagram showing a frame configuration of a signal in DECT communication. A wireless signal is transmitted and received between the master device 3 and each of the microphone slave devices 2, by using a default number (for example, n) of slots determined according to the communication standard every frame period. In the case where the communication standard is the DECT system, one frame period corresponds to 10 ms, and includes, for example, n=24 slots (that is, 12 slots for downlink and 12 slots for uplink).

In the wireless communication using the DECT system (hereinafter referred to as "DECT communication"), downlink slots S0 to S11 are generally used for communication from the master device 3 to the microphone slave device 2. The uplink slots S12 to S23 are used for communication from the microphone slave device 2 to the master device 3. In the communication between the master device 3 and the microphone slave device 2, slots having a positional relationship separated by 5 ms corresponding to ½ cycle, such as slot S0 and slot S12, slot S1 and slot S13, and the like are combined and used (in a pair slot). The pair slot constitutes one channel (for example, a control channel for transmitting and receiving control information and a communication channel for transmitting and receiving voice signals).

Further, at least one slot (for example, slot S0) among 12 slots where transmission is performed from the master device 3 to the microphone slave device 2 is a control slot for transmitting a control signal including control information from the master device 3 to the microphone slave device 2. The control signal is transmitted from the master device 3 to each of the microphone slave devices 2, by using one slot among a default number of slots constituting one frame period. In a case where radio interference occurs during transmission of the control signal from the master device 3 to the microphone slave device 2, an empty slot (in other words, an unused slot) may be used as the control slot. For example, in a case where radio interference or the like occurs in the slot S0, the master device 3 may switch the control slot from the slot S0 to another free slot (for example, a switching slot to be described later). In conjunction with this, the response slot to the control slot (that is, the slot used for the response to the control slot and used for transmission from the microphone slave device 2 to the master device 3) is changed from the slot S12 to another free slot (for example, similarly, a switching slot to be described later). In this way, the master device 3 dynamically determine the slots used as the control channel and the communication channel in each frame period of the DECT communication, according to the radio wave condition between the master device 3 and the microphone slave devices 2. For example, in a device such as a cordless phone, in the first half of the slots S0 to S11, the master device is the transmission side and the slave device is the reception side, and in the latter half of the slots S12 to S23, the master device is the reception side and the slave device is the transmission side.

On the other hand, in the wireless microphone system 5, the master device 3 receives voice signals transmitted from each of the plurality of microphone slave devices 2. Further, the master device 3 may transmit a control signal to each microphone slave device 2 once in one frame period. Therefore, in the present embodiment, the master device 3 dynamically determines the slots S0 to S11 such that the microphone slave device 2 can use the first half slots S0 to S11 as uplink slots (communication slots) which are the transmission side.

For example, the master device 3 determines slot S0 in one frame period as a control channel for transmitting a control signal and transmits the control signal to the microphone slave device 2 through the control channel. The control information included in the control signal is, for example, system information, slot information, and carrier information. Specifically, the control information includes, for example, identification information of the microphone slave device 2 which is a communication partner using a carrier and a slot, identification information of the carrier and the slot, and information such as a busy state of each slot, designation of available empty slots, the number of connected microphone slave devices, wireless error status of the master device, slot switching due to radio interference.

Each slot constituting one frame of the DECT communication is defined by a time width of 416.67 μs (=10 ms/24), and, specifically, includes a synchronization signal field, a control bit field, a CRC1 field, a data bit field, and a CRC2 Field. The synchronization signal field includes fixed data composed of a data sequence for bit synchronization and a data sequence for synchronizing slots. The control bit field includes the above-mentioned control signal. In a case where the amount of control information included in the control signal increases, for example, not only the control bit field but also a part of the area of the data bit field may be used. The CRC1 field includes a cyclic redundancy check (CRC) code calculated based on the data string of the control bit field and is used for detecting a transmission error of the control bit field. The data bit field is used for voice communication. The CRC2 field includes a CRC code calculated based on the data string of the data bit field and is used for detecting a transmission error of the data bit field.

Figure 5:
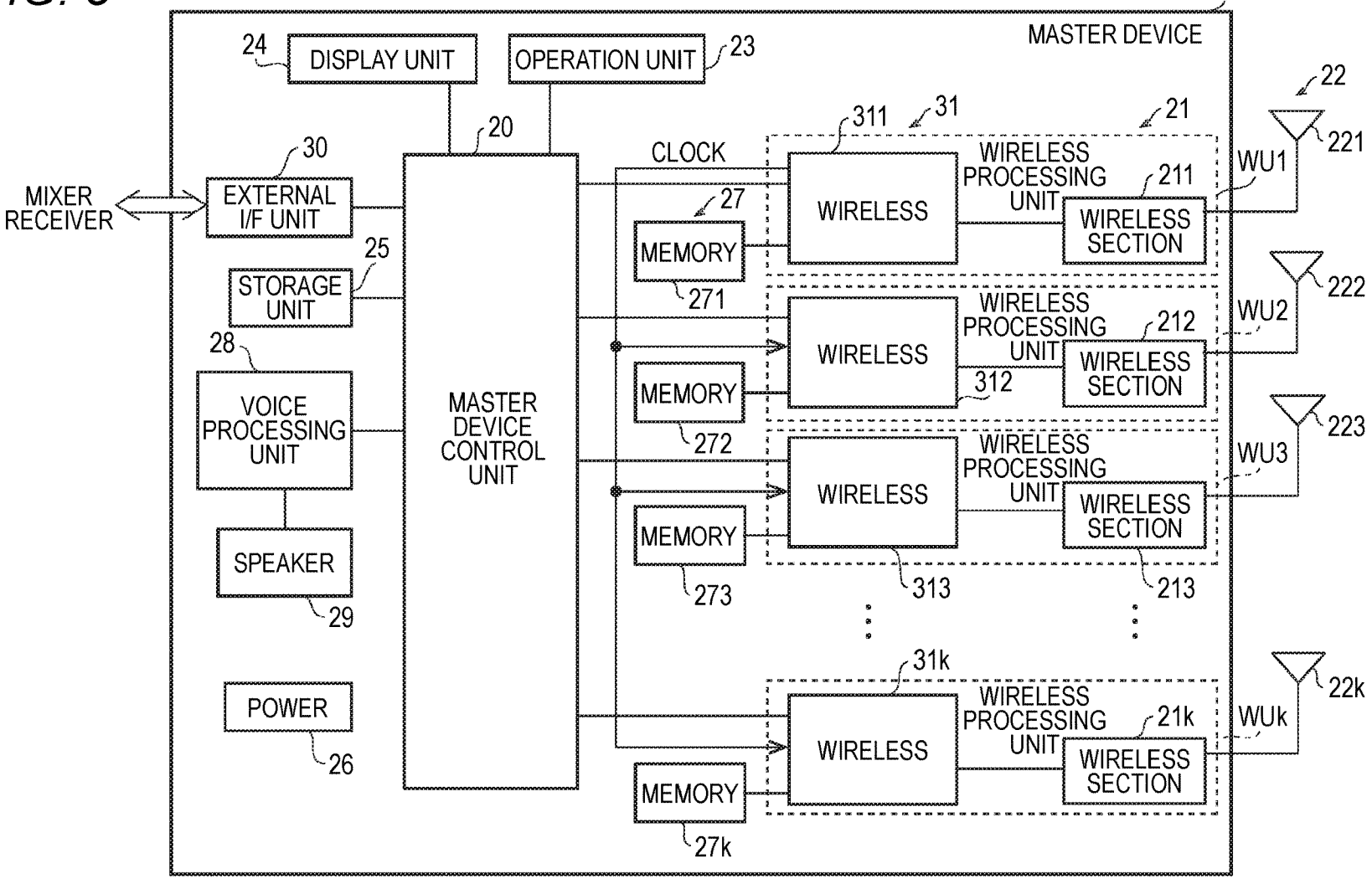
FIG. 5 is a block diagram showing an example of a hardware configuration of the master device.

FIG. 5 is a block diagram showing an example of a hardware configuration of the master device 3. The master device 3 includes a master device control unit 20 as an example of a control unit that controls each unit, a plurality (for example, k) of wireless processing units WU, a plurality of (for example, k) master device antennas 221 to 22*k* and a plurality (for example, k) of memories 271 to 27*k*. The master device antennas 221 to 22*k* are referred to as a master device antenna 22 unless otherwise distinguished. Similarly, the memories 271 to 27*k* are referred to as a memory 27 unless otherwise distinguished. The function of each of the units will be described later. Here, the number of k wireless processing units WU, the number of m microphone slave devices 2, and the number of n slots in one frame period have the relationship of Equation (1). In Equation (1), C indicates the number of communicable channels of m microphones.

[Expression 1]

$$C > k * \left\{\left(\frac{n}{2}\right) - 1\right\} \quad (1)$$

That is, in the present embodiment, the number of communicable channels (corresponding to C) of the m microphone slave devices 2 capable of multiplexing (in other words, capable of communicating) in one frame period in the DECT communication is larger than the product of k indicating the number of respective wireless processing units WU of the master device 3 and {(n/2)−1} obtained by subtracting 1 which is the number of slots used for the control slot from the maximum number (n/2) of multiplexing in one frame period. Thus, as compared with related art such as the above-described JP-A-2015-50727, in the master device 3, multiplexing is possible with microphone slave devices of the number of larger than the maximum number (n/2) of multiplexing of microphone slave devices that can be multiplexed in one frame period, and the master device 3 is capable of outputting a voice signal with good voice quality.

Further, the master device 3 includes an operation unit 23, a display unit 24, and a storage unit 25. The operation unit 23 includes a volume switch and a power switch as a user interface. The display unit 24 displays setting contents and the like by the operation unit 23. The storage unit 25 is a nonvolatile memory.

Further, the master device 3 includes a power 26, a voice processing unit 28, a speaker 29, and an external interface unit 30. The power 26 supplies electric power to each unit of the master device 3. The speaker 29 outputs and plays a voice signal. The external interface unit 30 is connected to the mixer receiver 8 and transmits the voice signal from the microphone slave device 2, which has undergone voice processing by the master device 3, to the mixer receiver 8. Further, the external interface unit 30 transmits and receives voice signals to and from other devices through a telephone line. The external interface unit 30 can transmit a voice signal from the microphone slave device 2, which has undergone voice processing by the master device 3, through a wireless line. Further, the external interface unit 30 may be connected to a network such as the Internet and can deliver voice signals through the network.

The master device control unit 20 is coupled to the storage unit 25 by a bus or the like. The master device control unit 20 controls the operation of each unit of the master device 3 and acquires the operation content input through the operation unit 23. Further, the master device control unit 20 sets the operation timings for each of the plurality of wireless processing units WU and the voice processing unit 28. Further, the master device control unit 20 generates a communication table 100 (see FIG. 7) to be described later and stores it in the storage unit 25. The master device control unit 20 transfers the communication table 100 stored in the storage unit 25 to the wireless control sections 311 to 31*k* of the respective wireless processing units WU. The wireless control sections 311 to 31*k* are referred to as a wireless control section 31 unless otherwise distinguished. In the communication table 100, either a control slot for notifying the microphone slave device 2 of the control signal or a communication slot for use for communication with the microphone slave device 2 is allocated to each carrier and slot and is registered. In each communication slot, a wireless processing unit WU that establishes a communication channel and a microphone slave device 2 are associated and registered. Details of the communication table 100 will be described later.

Further, the master device control unit 20 detects a transmission error of the compressed signal transmitted from the microphone slave device 2. Specifically, when the wireless section 21 in the wireless processing unit WU receives the compressed signal transmitted from the microphone slave device 2, the master device control unit 20 refers to the CRC2 field 54 which is an error detection field and detects presence or absence of a transmission error. The wireless sections 211 to 21*k* are referred to as a wireless section 21 unless otherwise distinguished.

Each of the plurality of wireless processing units WU has a wireless control section 31 and a wireless section 21, and performs wireless communication, by using any of the carriers having six different center frequencies f1 to f6 and not overlapping each other. The number of the wireless processing units WU may be six, or six or more if the number is two or more. Each wireless control section 31 controls wireless connection with the microphone slave device 2 and notifies each wireless section 21 of the carrier and slot designated from the master device control unit 20. That is, based on the communication table 100 received from the master device control unit 20, each wireless control section 31 controls the wireless section 21 so as to communicate with the microphone slave device 2 associated with the designated carrier and slot. The wireless section 21 communicates with the microphone slave device 2 with the designated carrier and slot through the radio antenna 22. In addition, each wireless control section 31 stores the voice signal from each microphone slave device 2 in each memory 27. The memory 27 is a dual port RAM and functions as a ring buffer.

Among the plurality of wireless control sections 311 to 31*k*, for example, the wireless control section 311 generates a clock signal for synchronizing the operations of the DECT communication in the respective wireless processing units WU1 to WUk and supplies other wireless control sections 312 to 31*k* with the same clock signal. Thereby, when performing the DECT communication with the plurality of microphone slave devices 2, the master device 3 can prevent the phase shift and the slot deviation of the communication signal. The supply source of the clock signal is not limited to the wireless control section 311, and any one of other wireless control sections 312 to 31*k* may perform the supply. Further, not only the wireless control sections 311 to 31*k*, but also the master device control unit 20 may supply the same clock signal to all the wireless control sections 311 to 31*k*, and similarly, the phase shift and the slot shift of the communication signal can be prevented.

Figure 6:
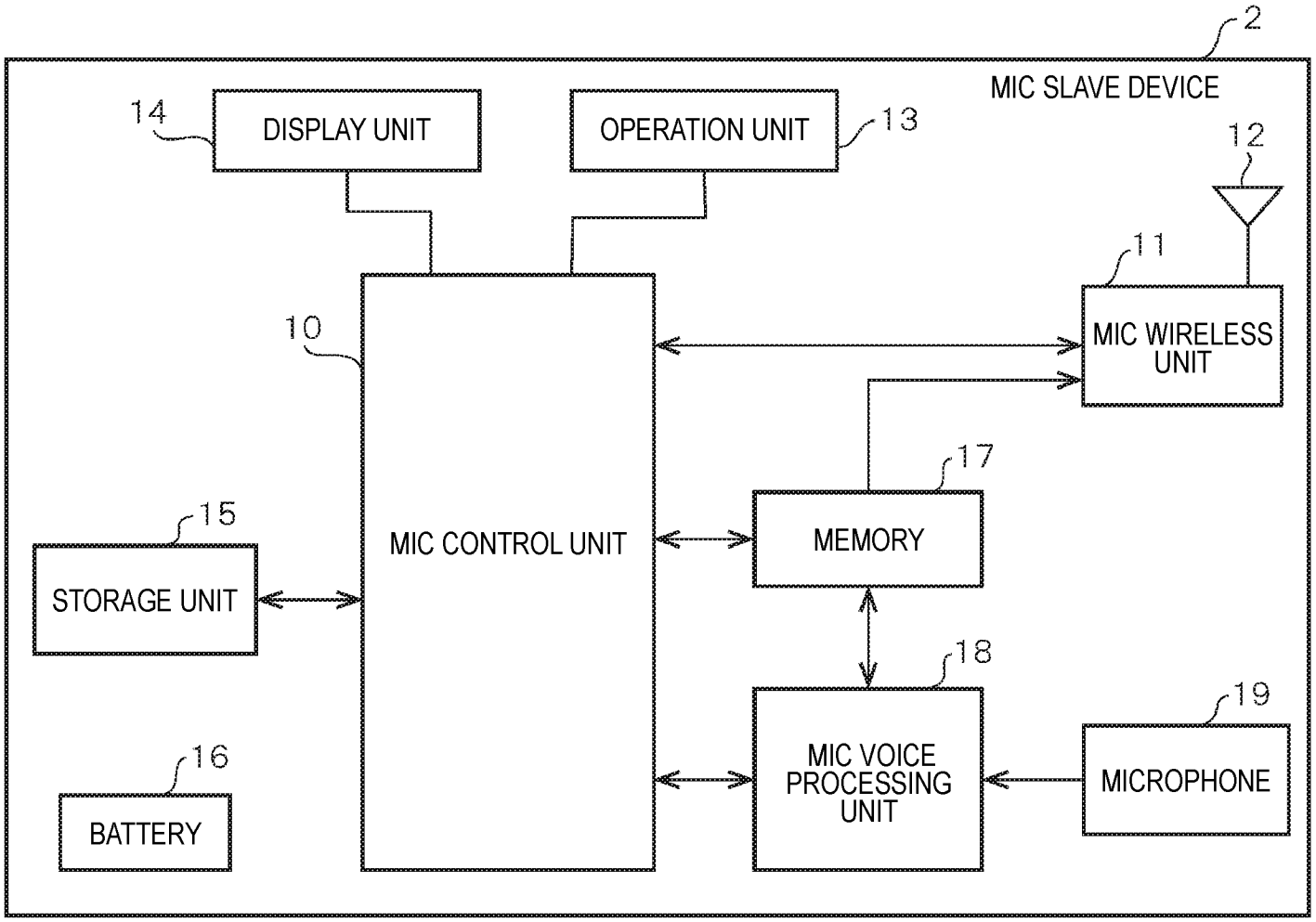
FIG. 6 is a block diagram showing an example of a hardware configuration of the microphone slave device.

FIG. 6 is a block diagram showing an example of a hardware configuration of the microphone slave device 2. The microphone slave device 2 as an example of the microphone includes a microphone control unit 10, a microphone wireless unit 11, and a microphone antenna 12 connected to the microphone wireless unit 11. Further, the microphone slave device 2 includes an operation unit 13 including a voice quality setting button and a switch for turning on/off the power as a user interface, a display unit 14 that displays setting contents and the like by the operation unit 13, and a storage unit 15 which is a nonvolatile memory. Further, the microphone slave device 2 includes a battery 16 for supplying power to each unit of the microphone slave device 2, a memory 17 which is a dual port random access memory (RAM) and functions as a ring buffer, a microphone voice processing unit 18, and a microphone 19 that inputs voice.

The microphone control unit 10 includes a central processing unit (CPU) coupled to the storage unit 15 through a bus or the like. The microphone control unit 10 controls the operation of each unit of the microphone slave device 2, and detects, for example, whether the voice quality setting button is pressed or not. In addition, the microphone control unit 10 sets these operation timings, for the microphone wireless unit 11 and the voice processing unit 18.

FIG. 7 is a diagram showing an example of registered contents of a communication table 100 showing a communication channel set for each carrier and each slot. The communication table 100 is stored in the storage unit 25, for example. Each column of the communication table 100 shows twelve slots S0 to S11 in the first half of one frame period in the DECT communication as the time axis. In addition, each row of the communication table 100 indicates the total number of six carriers used in the DECT communication, as the frequency axis. In FIG. 7, center frequencies f1 to f6 (refer to FIG. 2) of respective carriers are used to indicate carriers.

As shown in FIG. 7, in the communication table 100, control channels (indicated by rectangles) of the wireless processing unit WU, which are allocated in units of slots and carriers, and communication channels (indicated by microphones) with the microphone slave device 2, which is communication partner, multiplexed by the wireless processing unit WU are registered.

The master device control unit 20 monitors the communication status of each slot for each carrier in each frame period of DECT communication, determines the control channel and communication channel to be allocated to each slot of each carrier according to the communication situation, and rewrites the communication table 100. For example, in FIG. 7, the master device control unit 20 determines the slot S0 of the carrier of the center frequency f1 as the control channel of the wireless processing unit WU1 for notifying all of the microphone slave devices 2C1 to 2Cm connected to the master device 3 of control information that determines in which slot each of the wireless processing units WU1 to WUk communicates with which microphone slave device in one frame period. Similarly, the master device control unit 20 determines the slot S1 of the carrier of the center frequency f6 as the control channel of the wireless processing unit WU2 for notifying the above-described control information. Similarly, the master device control unit 20 determines the slot S5 of the carrier of the center frequency f6 as the control channel of the wireless processing unit WUk for notifying the above-described control information.

Further, the master device control unit 20 determines slots S1, S2, S4 to S7, S9, S10, and . . . of the carrier of the center frequency f1 and slots S2 to S4, and S7 to S10 of the carrier of the center frequency f6, as communication channels for receiving a voice signal between one of the plurality of wireless processing units WU1 to WUk and one of the microphone slave devices 2 specified by the control information. For example, the slot S2 of the carrier of the center frequency f1 is registered as the communication channel between the wireless processing unit WU5 and the microphone slave device 2C13. The slot S8 of the carrier having the center frequency f6 is registered as the communication channel between the wireless processing unit WU3 and the microphone slave device 2C8.

The master device control unit 20 determines each of the slots S3, S8, and S11 of the carrier of the center frequency f1 and the slots S0, S6, and S11 of the carrier of the center frequency f6 to be secured as, for example, free channels for switching and using the same slot as communication channels, instead of communication channels where radio interference is large. For example, in a case where it is determined that the communication status of the communication channel of the slot S4 of the carrier of the center frequency f1 is not good, the master device control unit 20 determines to switch the communication channel to the slot S6 of the carrier of the center frequency f6.

In this manner, the master device 3 uses a plurality of carriers in each slot and receives a voice signal through a plurality of communication channels designated in the communication table 100, from each of the plurality of microphone slave devices 2 assigned as communication partners multiplexed for each slot. In the communication table 100, the respective channels of the slots S0 to S11 which are slots for the first half downlink are shown, but the same applies to respective channels of the slots S12 to S23 which are the slots for the latter half of the uplink.

Next, the operation of the wireless microphone system 5 according to the present embodiment will be described.

Figure 8:
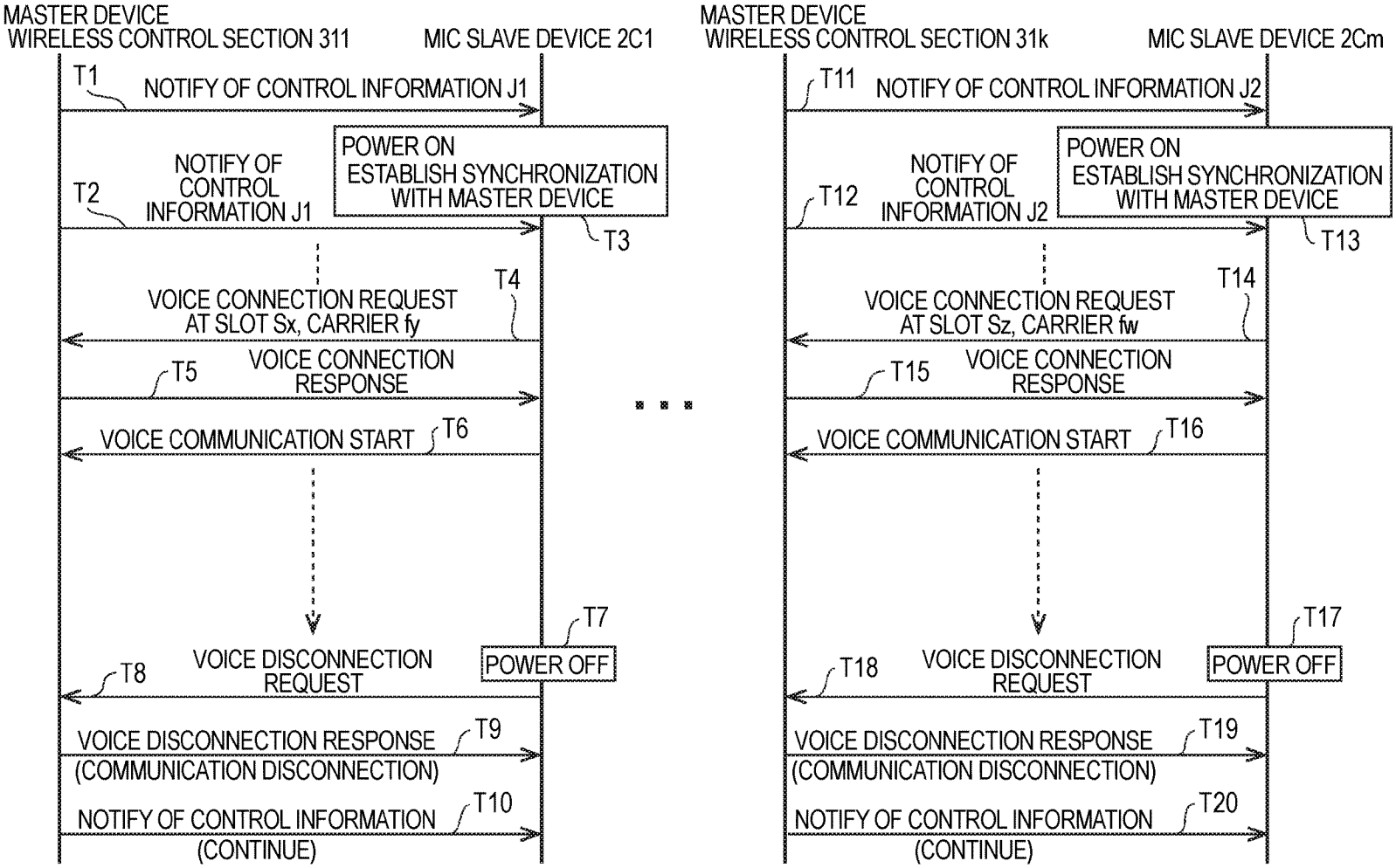
FIG. 8 is a sequence diagram showing a connection procedure of voice communication performed between each of the plurality of wireless processing units of the master device and each of the plurality of microphone slave devices.

FIG. 8 is a sequence diagram showing an example of a connection procedure of voice communication performed between each of the plurality of wireless processing units WU1 to WUk of the master device 3 and each of the plurality of microphone slave devices 2C1 to 2Cm. In FIG. 8, for example, a connection procedure of voice communication performed between the wireless processing unit WU1 including the wireless control section 311 and the microphone slave device 2C1 is shown, and similarly, a connection procedure of voice communication performed between the wireless processing unit WUk including the wireless control section 31*k* and the microphone slave device 2Cm is shown.

In FIG. 8, before starting the voice communication, the master device control unit 20 acquires identification information of each of all the microphone slave devices 2 capable of voice communication, holds the acquired identification information in the storage unit 25, generates a communication table 100 and stores the table in the storage unit 25. Further, the master device control unit 20 notifies the wireless control section 31 of each wireless processing unit WU of the data of the communication table 100.

The wireless control section 311 of the wireless processing unit WU1 notifies all the microphone slave devices 2 connected to the master device 3 of the control information J1, by using the carrier of the center frequency f1 and the slot S0 (T1). From the viewpoint of the transmission side, for example, the control information J1 is information that determines in which slot the wireless processing unit WU1 communicates with which microphone slave device 2 in one frame period, and for further determining which central frequency carrier to be used. In other words, the control information J1 includes the carrier and slot number that the microphone slave device 2 can use as a communication channel from the viewpoint of the receiving side. When the power is off, the microphone slave device 2C1 is not able to receive the control information J1 from the wireless processing unit WU1. Similarly, the wireless control section 311 notifies the microphone slave device 2C1 of the control information J1, by using the carrier of the center frequency f1 and the slot S0 again, in the next one frame period of the DECT communication, for example (T2).

When the microphone slave device 2C1 is activated by turning on the power by, for example, a user's operation (T3), it receives the control information J1 from the wireless control section 311. After activation, the microphone slave device 2C1 establishes synchronization for performing communication with the wireless control section 311. The microphone slave device 2C1 requests a voice connection from the wireless control section 311, based on the received control information J1, by using a carrier of a center frequency fx of an available number and a slot Sy (for example, x is any one of integers from 1 to 6 and y is any one of integers from 0 to 11 in DECT communication) (T4).

The wireless control section 311 responds to the voice connection request from the microphone slave device 2C1 (T5). Thus, voice communication is started between the wireless processing unit WU1 and the microphone slave device 2C1, by using the carrier of the center frequency fx and the slot Sy (T6). When the voice communication is started, the master device 3 can play the voice signal received by the wireless processing unit WU1 with the speaker 29 or outputs it to the mixer receiver 8. The mixer receiver 8 synthesizes the voice signal received by the wireless processing unit WU1 and the voice signal received by the other wireless processing unit and outputs the synthesized voice signal.

Thereafter, for example, when the power is turned off by a user operation (T7), the microphone slave device 2C1 requests the wireless control section 311 to disconnect the voice (T8). The wireless control section 311 responds to the voice disconnection from the microphone slave device 2C1 (T9). When the voice is disconnected, the wireless control section 311 continues notification of the control information as in the procedure T1 (T10). This notification of the control information is also made to other microphone slave devices 2 based on the communication table 100 generated by the master device 3 for each one frame period or for several frame periods. The reason why the communication table 100 may be generated for every several frame periods is because in consideration of the possibility that, for example, all the processes in the master device 3 cannot be completed within one frame, in this case, the master device 3 may update the communication table 100 by taking several frame periods. Thereafter, the same operation is performed.

Operations similar to the procedures T1 to T10 are also performed in the wireless processing units WU2 to WUk. That is, the combination of the wireless processing units WU1 to WUk and the microphone slave devices 2C1 to 2Cm to which voice communication connection is performed is random. For example, in the combination of the wireless processing unit WUk and the microphone slave device 2Cm, the following operation is performed.

The wireless control section 31*k* of the wireless processing unit WUk notifies the microphone slave device 2Cm specified as the communication partner (multiplexing destination) in the corresponding slot based on the communication table 100 of control information J2, by using the carrier of the center frequency f2 and the slot S0 (T11). From the viewpoint of the transmission side, for example, the control information J2 is information that determines in which slot the wireless processing unit WU2 communicates with which microphone slave device 2 in one frame period, and for further determining which central frequency carrier to be used. In other words, the control information J2 includes, for example, the carrier and slot number that the microphone slave device 2Cm can use as a control channel or a communication channel from the viewpoint of the receiving side. When the power is off, the microphone slave device 2Cm is not able to receive the control information J2 from the wireless processing unit WUk. Similarly, the wireless control section 31*k* notifies the microphone slave device 2Cm of the control information J2, by using the carrier of the center frequency f2 and the slot S0 again, in the next one frame period of the DECT communication, for example (T12).

When the microphone slave device 2Cm is activated by turning on the power by, for example, a user's operation (T13), it receives the control information J2 from the wireless control section 31*k*. After activation, the microphone slave device 2Cm establishes synchronization for performing communication with the wireless control section 31*k*. The microphone slave device 2Cm requests a voice connection from the wireless control section 31*k*, based on the received control information J2, by using a carrier of a center frequency fz of an available number and a slot Sw (for example, z is any one of integers from 1 to 6 and w is any one of integers from 0 to 11 in DECT communication) (T14).

The wireless control section 31*k* responds to the voice connection request from the microphone slave device 2Cm (T15). Thus, voice communication is started between the wireless processing unit WUk and the microphone slave device 2Cm by using the carrier of the center frequency fz and the slot Sw (T16). When the voice communication is started, the master device 3 can play the voice signal received by the wireless processing unit WUk with the speaker 29 or outputs it to the mixer receiver 8. The mixer receiver 8 synthesizes the voice signal received by the wireless processing unit WUk and the voice signal received by the other wireless processing unit and outputs the synthesized voice signal.

Thereafter, for example, when the power is turned off by a user operation (T17), the microphone slave device 2Cm requests the wireless control section 31*k* to disconnect the voice (T18). The wireless control section 31*k* responds to the voice disconnection from the microphone slave device 2Cm (T19). When the voice is disconnected, the wireless control section 31*k* continues notification of the control information as in the procedure T11 (T20). This notification of the control information is also made to other microphone slave devices 2 based on the communication table 100 generated by the master device 3 for each one frame period or for several frame periods. Thereafter, the same operation is performed.

Figure 9:
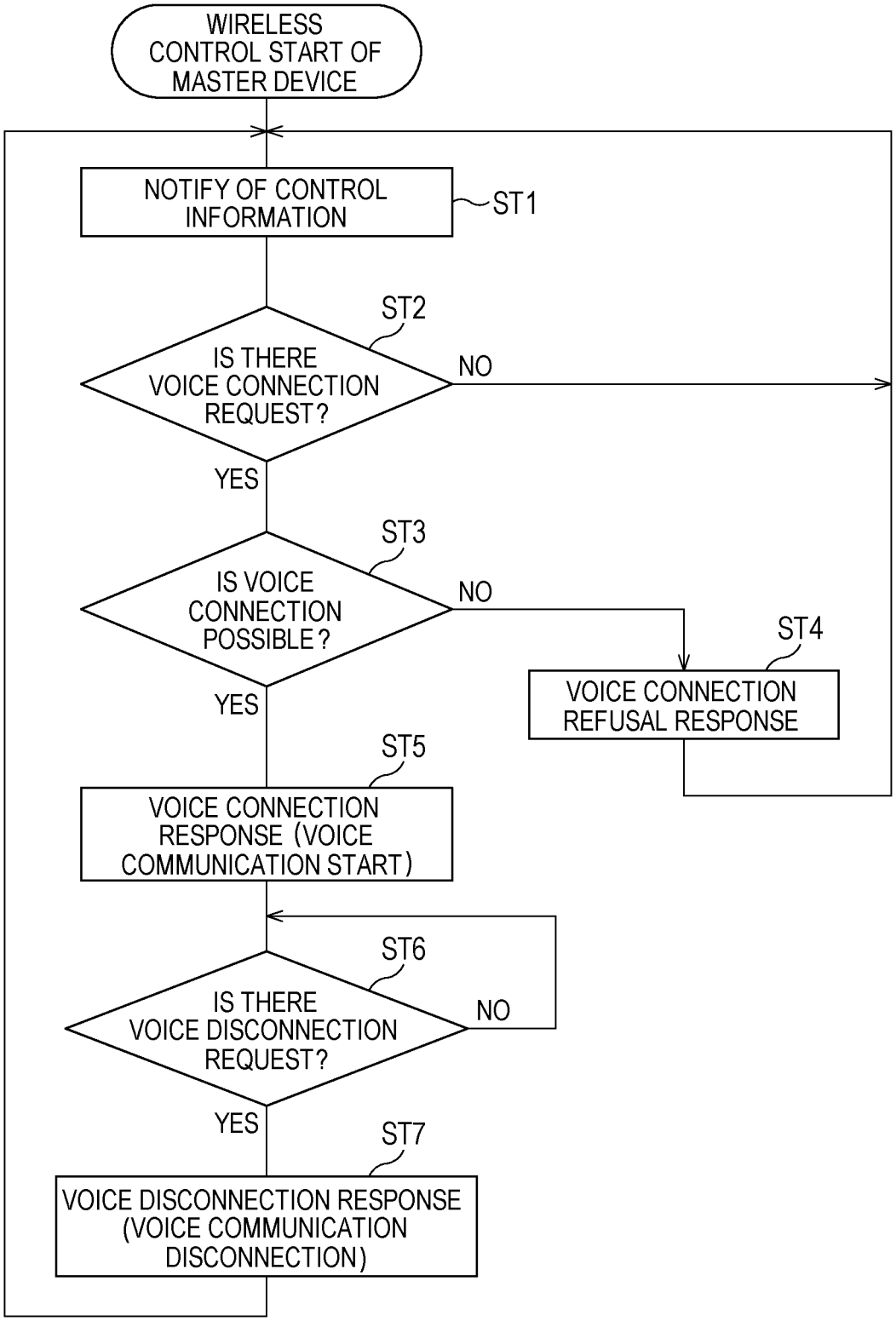
FIG. 9 is a flowchart showing an operation procedure of a wireless control section of the wireless processing unit of the master device.

FIG. 9 is a flowchart showing an operation procedure of the wireless control section 31 of the wireless processing unit WU of the master device 3. The wireless control section 31 generates the above described control information every frame period or every several frame periods of the DECT communication and notifies all the microphone slave devices 2 connected to the master device 3 of the control information (ST1). After notification of the control information, the wireless control section 31 determines whether or not there is a voice connection request from the microphone slave device 2 specified in the communication table 100 included in the control information (ST2). In a case where there is no voice connection request (ST2, NO), the process of the wireless control section 31 returns to step ST1, and the wireless control section 31 notifies of the control information J again, for example, in the next one frame period of the DECT communication.

On the other hand, in a case where there is a voice connection request from the microphone slave device 2 (ST2, YES), the wireless control section 31 determines whether or not voice connection is possible using the carrier and slot requested by the microphone slave device 2, based on, for example, the communication table 100 (ST3). In a case where voice connection cannot be established (ST3, NO), the wireless control section 31 responds with a voice connection refusal (ST4). Thereafter, the process of the wireless processing unit WU returns to step ST1.

On the other hand, in a case where voice connection is possible (ST3, YES), the wireless control section 31 responds with the voice connection using the requested carrier and slot (ST5). Thus, voice communication is started between the wireless processing unit WU and the microphone slave device 2.

Thereafter, the wireless control section 31 determines whether or not there is a voice disconnection request from the microphone slave device 2 at which voice communication is started (ST6). In a case where there is no voice disconnection request (ST6, NO), the wireless processing unit WU repeats the process of step ST6. Further, in a case where there is a voice disconnection request from the microphone slave device 2 (ST6, YES), the wireless control section 31 responds with voice disconnection (ST17). After voice disconnection, the process of the wireless control section 31 returns to step ST1 and the wireless control section 31 notifies of the control information J again at frame intervals, for example, in the next one frame period of the DECT communication.

Figure 10:
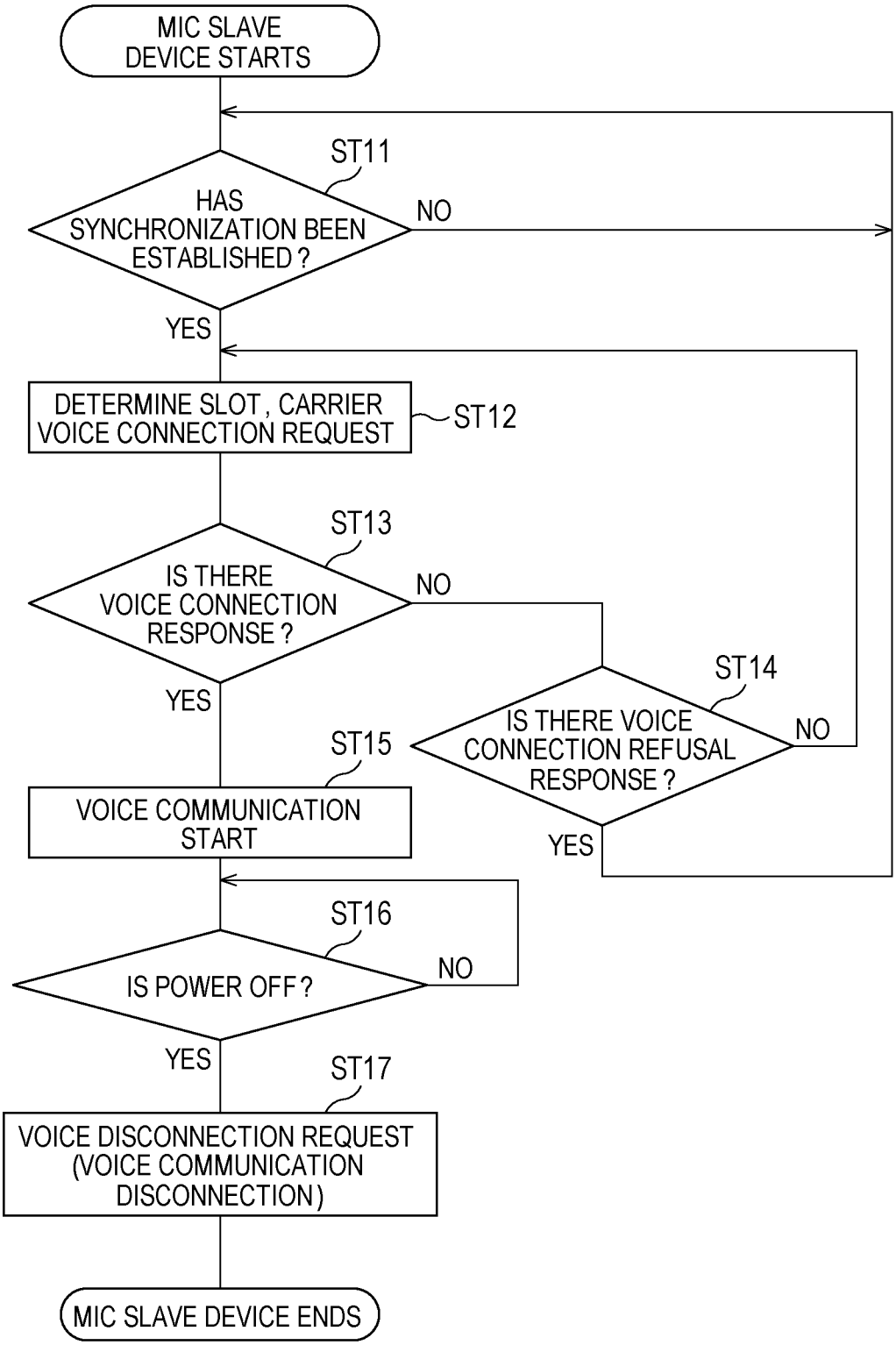
FIG. 10 is a flowchart showing an operation procedure of a microphone control unit of the microphone slave device.

FIG. 10 is a flowchart showing an operation procedure of the microphone control unit 10 of the microphone slave device 2. The operation of the microphone slave device 2 shown in FIG. 10 is started when the microphone slave device 2 is powered on, for example, by a user operation. After turning on the power, the microphone slave device 2 receives the control information transmitted from the wireless processing unit WU of the master device 3 and determines whether or not synchronization for wireless communication with the wireless processing unit WU has been established (ST11). In a case where synchronization for wireless communication with the wireless processing unit WU has not been established (ST11, NO), the process of the microphone slave device 2 returns to step ST11.

On the other hand, when synchronization for wireless communication with the wireless processing unit WU has not been established (ST11, YES), the microphone control unit 10 determines the carrier and slot number based on the received control information and requests a voice connection from the wireless processing unit WU (ST12).

The microphone control unit 10 determines whether or not there is a voice connection response to this request from the wireless processing unit WU (ST13). In a case where there is no voice connection response (ST13, NO), the microphone control unit 10 determines whether or not there is a voice connection refusal response from the wireless processing unit WU (ST14). In a case where there is no voice connection refusal response (ST14, NO), the process of the microphone control unit 10 returns to step ST12, and the microphone control unit 10 determines again the carrier and slot number based on the received control information and requests for voice connection (ST12).

On the other hand, in a case where there is a voice connection refusal response from the wireless processing unit WU (ST14, YES), the process of the microphone control unit 10 returns to step ST11, and the microphone control unit 10 attempts to establish synchronization for wireless communication with another wireless processing units WU and determines whether or not wireless synchronization with another wireless processing unit WU has been established.

On the other hand, in a case where there is a voice connection response from the wireless processing unit WU (ST13, YES), the microphone control unit 10 starts voice communication with the wireless processing unit WU (ST15). During voice communication, the microphone control unit 10 waits until the user turns off the power (ST16). When the power is turned off, the microphone control unit 10 requests the wireless processing unit WU to disconnect the voice (ST17). When receiving a voice disconnection response from the wireless processing unit WU in response to this request, the microphone control unit 10 is powered off.

As described above, in the wireless microphone system 5 according to Embodiment 1, the master device control unit 20 in the master device 3 generates a communication table 100 in which a carrier and a slot to be used for communication with m (m: an integer of 2 or more) microphone slave device 2 are set for each one frame period, by using a default number (six) of carriers based on the time division multiplex communication system (for example, DECT system) and n (n: default positive integer) slots constituting the one frame period of the DECT system. The master device 3 performs communication using the DECT system with the corresponding individual microphone slave devices 2, among the m microphone slave devices 2, based on the generated communication table 100, in k (k: an integer of 2 or more) wireless processing units WU. The k wireless processing units WU respectively operate synchronously based on the same clock signal. Further, C indicating the number of communicable channels of m microphone slave devices 2 has a relationship of $C>k*\{(n/2)-1\}$.

Thus, the master device 3 can establish communication channels with the microphone slave devices 2 of the number of multiplexing or more using a default number of slots constituting one frame period of time division multiplex communication system and allocate a communication channel to each microphone slave device 2 for each carrier and each slot. For example, in a case where the number of multiplexing is 12 communication channels, the control channel can be allocated to one channel and the communication channel can be allocated to 11 channels at maximum for each carrier. Therefore, in a case when the number of carriers is six, it is possible to establish a communication channel of 6*11 channels or more. * (Asterisk) is a multiplication operator. Therefore, it is possible to increase the number of microphone slave devices 2 connectable to the master device 3, and to increase the amount of voice data, thereby improving the voice quality. Since the operations of the plurality of wireless processing units WU are synchronized in the same clock signal, occurrence of phase shift and slot shift between the wireless processing units WU can be prevented. In this manner, the master device 3 communicates with slave devices of the number of multiplexing or more that are communicable within one frame period in a communication system related to communication performed with the microphone slave device 2 which is a communication partner, and it is possible to output a voice signal having good voice quality with high accuracy.

Any one of the k wireless processing units WU generates a clock signal and supplies it to the remaining (k−1) wireless processing unit. Thus, it is possible to share the clock signal supplied to the k wireless processing units WU. Further, the number of parts can be reduced as compared with the case where each wireless processing unit WU generates a clock signal.

When receiving a voice connection request including information on a carrier and a slot, from the corresponding microphone slave device 2 among m microphone slave devices 2, based on the communication table 100, *k* wireless processing units WU start communication with the microphone. Thus, each wireless processing unit WU can reliably start communication with the corresponding microphone slave device 2, and interference can be avoided.

When receiving a voice disconnection request from the corresponding microphone slave devices 2 among the m microphone slave devices 2 that perform communication, k wireless processing units WU disconnect (terminate) communication with the microphone slave device 2. Thus, each wireless processing unit WU can reliably disconnect communication with the corresponding microphone slave device 2.

Embodiment 2

In Embodiment 1, each of the plurality of wireless processing units WU in the master device 3 notifies the plurality of microphone slave devices 2 of the control information and performs radio connection with one of the microphone slave devices. In Embodiment 2, an example is described in which a plurality of wireless processing units in the master device 3 are divided into sets each having two wireless processing units which are paired with each other in one-to-one relationship, one of the pair is set as a main wireless processing unit, the other is set as a sub wireless processing unit, and the main wireless processing unit also serves as the wireless control of the sub wireless processing unit, in each set. Therefore, in the present embodiment, (k/2) pairs are formed. In the present embodiment, k is a natural number that is a multiple of 2.

The hardware configuration of the wireless microphone system of Embodiment 2 is the same as the hardware configuration of the wireless microphone system of Embodiment 1. The same reference numerals are used for the same constituent elements as those in Embodiment 1, and a description thereof will be omitted.

Figure 11:
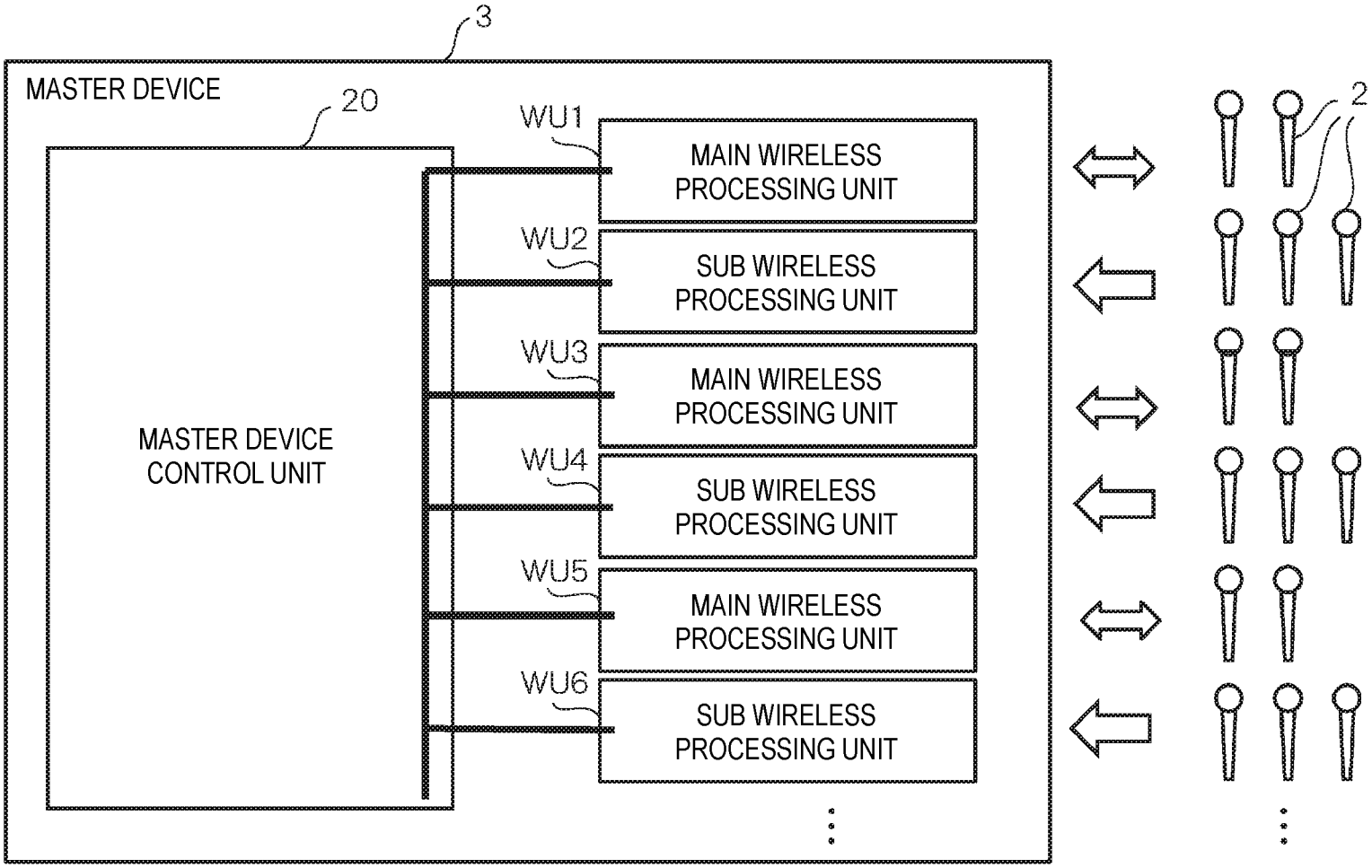
FIG. 11 is a diagram schematically showing a configuration of a portion related to wireless connection of a master device in Embodiment 2.

FIG. 11 is a diagram schematically showing a configuration of a portion related to wireless connection of a master device 3 in Embodiment 2. A plurality of wireless processing units WU is divided into pairs (sets) of two wireless processing units which are one main wireless processing unit and one sub wireless processing unit. For example, a pair having the wireless processing unit WU1 as the main wireless processing unit, and the wireless processing unit WU2 as the sub wireless processing unit is formed. Further, a pair having the wireless processing unit WU3 as the main wireless processing unit, and the wireless processing unit WU4 as the sub wireless processing unit is formed. Similarly, a pair having the wireless processing unit WU5 as the main wireless processing unit, and the wireless processing unit WU6 as the sub wireless processing unit is formed.

The wireless processing unit WU1 substitutes the wireless control of the wireless processing unit WU2. In this substitution, the wireless processing unit WU1 transmits the voice connection using the carrier and slot requested from the microphone slave device 2, to the master device control unit 20. The master device control unit 20 notifies the wireless processing unit WU2 of the voice connection using the carrier and slot transmitted from the wireless processing unit WU1. Further, the wireless processing unit WU1 transmits the voice disconnection using the carrier and slot requested from the microphone slave device 2, to the master device control unit 20. The master device control unit 20 notifies the wireless processing unit WU2 of the voice disconnection using the carrier and slot transmitted from the wireless processing unit WU1. These substituting operations are similarly performed between another main wireless processing unit (for example, the wireless processing unit WU3 or WU5) and another sub wireless processing unit (for example, the wireless processing unit WU4 or WU6).

Figure 12:
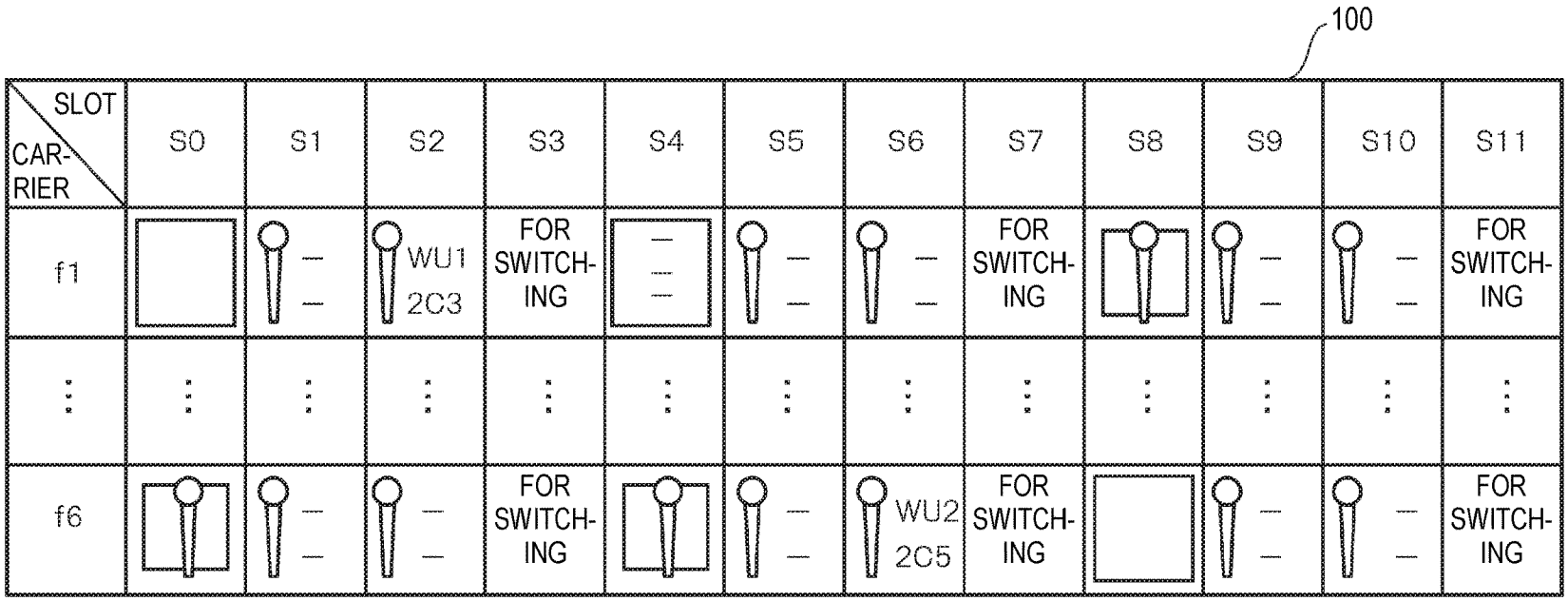
FIG. 12 is a diagram showing an example of registered contents of a communication table showing a communication channel set for each carrier and each slot.

FIG. 12 is a diagram showing an example of registered contents of a communication table 100 showing a communication channel set for each carrier and each slot. As in FIG. 7, the communication table 100 is stored in the storage unit 25, for example. Each column of the communication table 100 shows twelve slots S0 to S11 in the first half of one frame period in the DECT communication as the time axis. In addition, each row of the communication table 100 indicates the total number of six carriers used in the DECT communication, as the frequency axis. In FIG. 12, center frequencies f1 to f6 (refer to FIG. 2) of respective carriers are used to indicate carriers.

As shown in FIG. 12, in the communication table 100, control channels (indicated by rectangles) of the wireless processing unit WU, which are allocated for each carrier and slot, and communication channels (indicated by microphones) with the microphone slave device 2, which is communication partner, multiplexed by the wireless processing unit WU are registered.

The master device control unit 20 monitors the communication status of each slot for each carrier in each frame period of DECT communication, determines the control channel and communication channel to be allocated to each slot of each carrier according to the communication situation, and rewrites the communication table 100. For example, in FIG. 12, the master device control unit 20 determines the slot S0 of the carrier of the center frequency f1 as the control channel for notifying all of the microphone slave devices 2C1 to 2Cm connected to the master device 3 of control information that determines in which slot the main wireless processing unit of each pair and the sub wireless processing unit of the same pair communicate with which microphone slave device 2 in one frame period. This makes it unnecessary for the master device 3 to allocate the control channel for notifying each microphone slave device of the control information in the sub wireless processing units in each pair, as compared with Embodiment 1. Therefore, as compared with Embodiment 1, the master device 3 can allocate carriers and slots for allocating the control channel to the sub wireless processing unit, to the communication channel with the microphone slave device 2 (see the carrier of the center frequency f6 and the slot S0 in FIG. 7).

Similarly, the master device control unit 20 determines the carrier of the center frequency f6 and the slot S8 as the control channel for notifying similar control information. Therefore, similarly, as compared with Embodiment 1, the master device 3 can allocate carriers and slots for allocating the control channel to the sub wireless processing unit, to the communication channel with the microphone slave device 2 (see the carrier of the center frequency f1 and the slot S8 in FIG. 7).

Further, similarly to Embodiment 1, the master device control unit 20 determines slots S1, S2, S5, S6, S8 to S10, and . . . of the carrier of the center frequency f1 and slots S0 to S2, S4 to S6, S9, and S10 of the carrier of the center frequency f6, as communication channels for receiving a voice signal between one of the plurality of wireless processing units WU1 to WUk and one of the microphone slave devices 2 specified by the control information.

Similarly to Embodiment 1, the master device control unit 20 determines each of the slots S3, S7, S11, and . . . of the carrier of the center frequency f1 and the slots S3, S7, and S11 of the carrier of the center frequency f6 to be secured as, for example, free channels for switching and using the same slot as communication channels, instead of communication channels where radio interference is large.

Next, the operation of the wireless microphone system 5 according to the present embodiment will be described.

Figure 13:
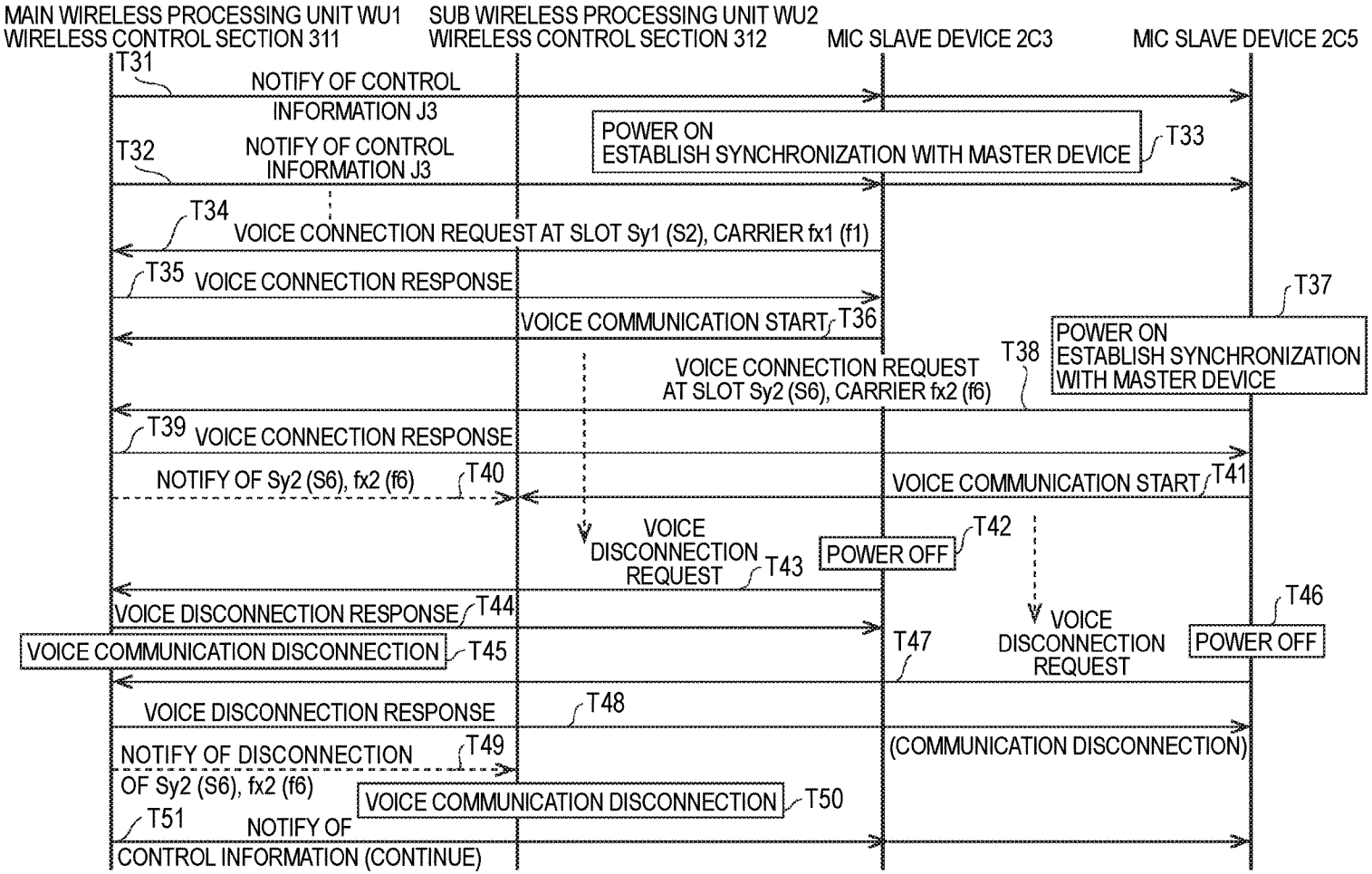
FIG. 13 is a sequence diagram showing an example of a connection procedure of voice communication performed between a main wireless processing unit and a microphone slave device and between a sub wireless processing unit and a microphone slave device.

FIG. 13 is a sequence diagram showing an example of a connection procedure of voice communication performed between the main wireless processing unit and the microphone slave device and between the sub wireless processing unit and the microphone slave device 2C5. In FIG. 13, the wireless processing unit WU1 and the wireless processing unit WU2 are illustrated as a pair of the main wireless processing unit and the sub wireless processing unit, respectively, but the same applies to other pairs.

In FIG. 13, before starting the voice communication, the master device control unit 20 acquires identification information of each of all the microphone slave devices 2 capable of voice communication, holds the acquired identification information in the storage unit 25, generates a communication table 100 and stores the table in the storage unit 25. Further, the master device control unit 20 notifies the wireless control section 31 of each wireless processing unit WU of the data of the communication table 100.

The wireless control section 311 of the wireless processing unit WU1 notifies all the microphone slave devices 2 connected to the master device 3 of the control information J3, by using the carrier of the center frequency f1 and the slot S0 (T31). From the viewpoint of the transmission side, the control information J3 is information that determines in which slot the main wireless processing unit (for example, wireless processing unit WU1) and the sub wireless processing unit (for example, wireless processing unit WU2) of the same pair communicate with which microphone slave device 2 in one frame period, and for further determining which central frequency carrier to be used. In other words, the control information J3 includes the carrier and slot number that the microphone slave device 2 can use as a control channel or a communication channel from the viewpoint of the receiving side. Since both of the two microphone slave devices 2C3 and 2C5 are powered off, they cannot receive the control information J3 from the wireless processing unit WU1. Similarly, the wireless control section 311 notifies the microphone slave devices (for example, microphone slave devices 2C3 and 2C5) which are communication destinations of the control information J3, by using the carrier of the center frequency f1 and the slot S0 again, in the next one frame period of the DECT communication, for example (T32).

When the microphone slave device 2C3 is activated by turning on the power by, for example, a user's operation (T33), it receives the control information J3 from the wireless processing unit WU1. After activation, the microphone slave device 2C3 establishes synchronization for performing communication with the wireless processing unit WU1. The microphone slave device 2C3 requests a voice connection from the wireless control section 311, based on the received control information J3, by using a carrier of a center frequency fx1 of an available number and a slot Sy1 (for example, x1 is any one of integers from 1 to 6 and y1 is any one of integers from 0 to 11 in DECT communication), for example, fx1 (x1=1) and a slot S2 (y1=2) (T34).

The wireless control section 311 responds to the voice connection request from the microphone slave device 2C3 (T35). Thus, voice communication is started between the wireless control section 311 and the microphone slave device 2C3, by using the carrier of the center frequency f1 and the slot S2 (T36). When the voice communication is started, the master device 3 can play the voice signal received by the wireless processing unit WU1 with the speaker 29 or outputs it to the mixer receiver 8. The mixer receiver 8 synthesizes the voice signal received by the wireless processing unit WU1 and the voice signal received by the other wireless processing unit and outputs the synthesized voice signal.

On the other hand, when the microphone slave device 2C5 is activated by turning on the power by, for example, a user's operation (T37), it receives the control information J3 from the wireless processing unit WU1. After activation, the microphone slave device 2C5 establishes synchronization for performing communication with the wireless processing unit WU1. The microphone slave device 2C5 requests a voice connection from the wireless control section 311, based on the received control information J3, by using a carrier of a center frequency fx2 of an available number and a slot Sy2 (for example, x2 is any one of integers from 1 to 6 and y2 is any one of integers from 0 to 11 in DECT communication), for example, a carrier of a center frequency f6 (x2=6) and a slot S6 (y2=6) (T38).

The wireless control section 311 responds to the voice connection request from the microphone slave device 2C5 (T39). Further, the wireless control section 311 notifies the wireless processing unit WU2 of the voice connection using the carrier of the center frequency f5 and the slot S6 requested from the microphone slave device 2C5 through the master device control unit 20 (T40).

When the wireless processing unit WU2 is notified of the voice connection using the carrier of the center frequency f6 and the slot S6, voice communication using the carrier of the center frequency f6 and the slot S6 is started between the wireless control section 312 of the wireless processing unit WU2 and the microphone slave device 2C5 (T41). When the voice communication is started, the master device 3 can play the voice signal received by the wireless processing unit WU2 with the speaker 29 or outputs it to the mixer receiver 8. The mixer receiver 8 synthesizes the voice signal received by the wireless processing unit WU2 and the voice signal received by the other wireless processing unit (for example, the wireless processing unit WU1) and outputs the synthesized voice.

Thereafter, for example, when the power is turned off by a user operation (T42), the microphone slave device 2C3 requests the wireless processing unit WU1 to disconnect the voice (T43). The wireless processing unit WU1 responds to the voice disconnection from the microphone slave device 2C3 (T44). The wireless processing unit WU1 disconnects the voice communication with the microphone slave device 2C3 (T45).

Further, for example, when the power is turned off by a user operation (T46), the microphone slave device 2C5 requests the wireless processing unit WU1 to disconnect the voice (T47). The wireless processing unit WU1 responds to the voice disconnection from the microphone slave device 2C5 (T48). Further, the wireless processing unit WU1 notifies the wireless control section 312 of the wireless processing unit WU2 of the voice disconnection using the carrier of the center frequency f2 and the slot S6 through the master device control unit 20 (T49). When receiving the voice disconnection notification from the wireless processing unit WU1, the wireless control section 312 disconnects the voice communication with the microphone slave device 2C5 (T 50).

When the voice is disconnected between the microphone slave devices 2C3 and 2C5, the wireless processing unit WU1 continues notification of the control information as in the procedure T31 (T51). This notification of the control information is also made to other microphone slave devices 2 based on the communication table 100 generated by the master device 3 for each one frame period. Thereafter, the same operation is performed.

Figure 14:
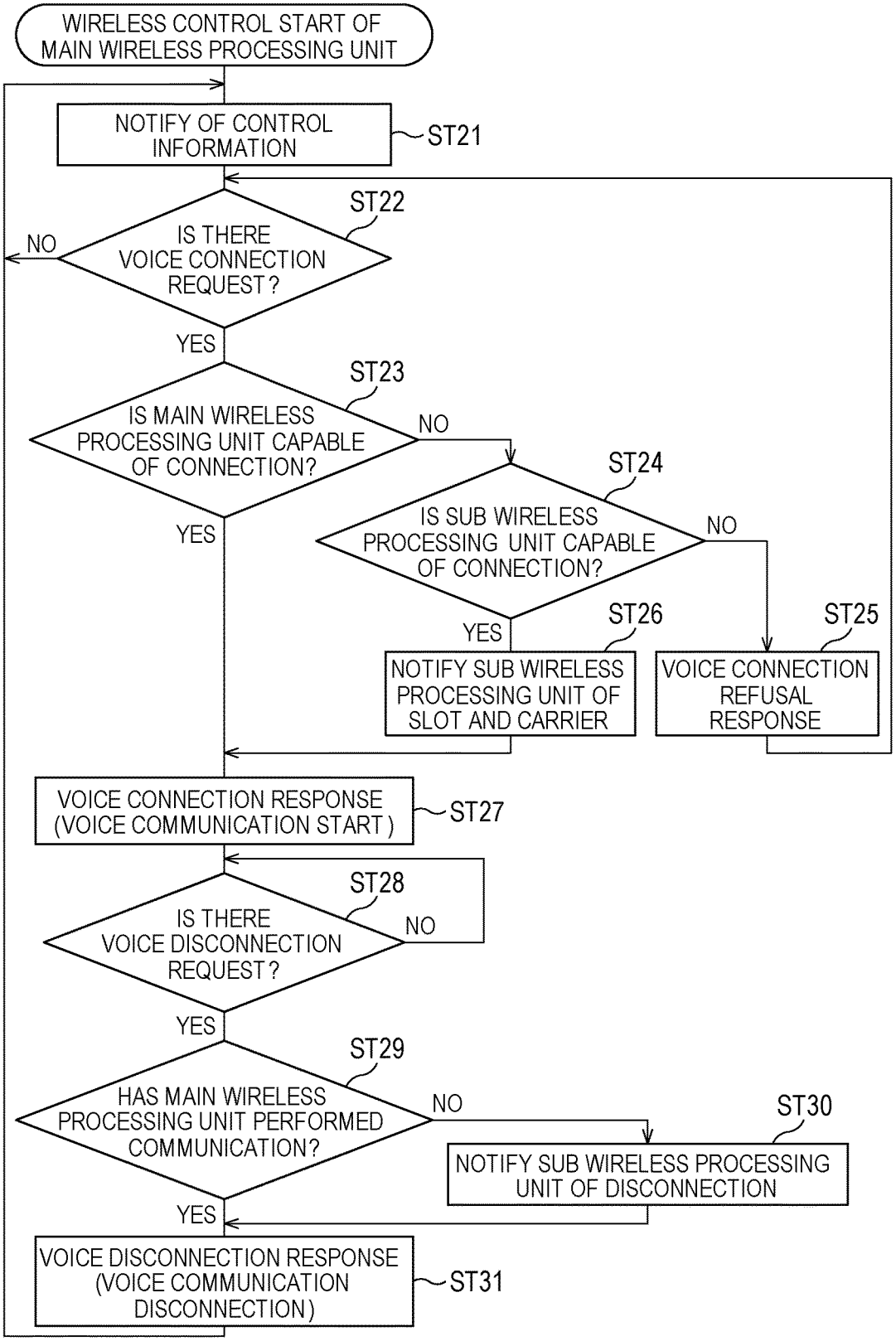
FIG. 14 is a flowchart showing an example of an operation procedure of a wireless control section of the main wireless processing unit of the master device.

FIG. 14 is a flowchart showing an example of an operation procedure of the wireless control section of the main wireless processing unit of the master device 3. Similarly to FIG. 13, the main wireless processing unit is described as the wireless processing unit WU1 and the sub wireless processing unit is described as the wireless processing unit WU2, but the same applies to the other pairs of the main wireless processing unit and the sub wireless processing unit. The wireless control section 311 corresponding to the main wireless processing unit generates the above described control information J3 every frame period or every several frame periods of the DECT communication and notifies all the microphone slave devices 2 connected to the master device 3 of the control information J3 (ST21). After notification of the control information J3, the wireless control section 311 determines whether or not there is a voice connection request from any one of the plurality of microphone slave devices 2 (ST22). In a case where there is no connection request (ST22, NO), the process of the wireless control section 311 returns to step ST21, and the wireless control section 311 notifies of the control information J3 again, for example, in the next one frame period of the DECT communication.

On the other hand, in a case where there is a voice connection request from the microphone slave device 2 (for example, the microphone slave device 2C3 or the microphone slave device 2C5) (ST22, YES), the wireless control section 311 determines whether or not voice connection is possible using the carrier and slot requested by the microphone slave device 2C3 or the microphone slave device 2C5, based on, for example, the communication table 100 (ST23). When the voice connection cannot be established (ST23, NO), the wireless control section 311 determines whether or not the wireless processing unit WU2 corresponding to the sub wireless processing unit is capable of voice connection (ST24). In a case where the voice connection cannot be established in the wireless processing unit WU2 (ST24, NO), the wireless control section 311 responds to the microphone slave device 2 with a voice connection refusal (ST25). Thereafter, the process of the wireless control section 311 returns to step ST22.

On the other hand, in a case where the wireless control section 311 can perform voice connection (ST23, YES), the wireless control section 311 responds to the microphone slave device 2C3 or the microphone slave device 2C5 with the voice connection, by using the requested carrier and slot (ST27). Thus, voice communication is started between the wireless processing unit WU1 and the microphone slave device 2.

Further, in a case where the wireless processing unit WU2 can perform voice connection (ST24, YES), the wireless control section 311 notifies the wireless processing unit WU2 of the corresponding carrier and slot based on the communication table 100 (ST26). In a case where the wireless processing unit WU2 can perform voice connection, the wireless control section 311 responds to the microphone slave device 2 (for example, the microphone slave device 2C5) with voice connection. Thus, voice communication is started between the wireless processing unit WU2 and the microphone slave device 2C5.

Thereafter, the wireless control section 311 determines whether or not there is a voice disconnection request for carriers and slots from the microphone slave device 2C3 or the microphone slave device 2C5 at which voice communication is started (ST28). In a case where there is no voice disconnection request (ST28, NO), the wireless control section 311 repeats the process of step ST28. Further, in a case where there is a voice disconnection request from the microphone slave device 2C3 or the microphone slave device 2C5 (ST28, YES), the wireless control section 311 determines whether or not voice communication by the wireless processing unit WU1 has been performed (ST29). In a case where voice communication by the wireless processing unit WU1 has been performed (ST29, YES), the wireless control section 311 responds to the microphone slave device 2C3 or the microphone slave device 2C5 with voice disconnection (ST31). Thus, voice communication is disconnected between the main wireless processing unit WU1 and the microphone slave device 2.

On the other hand, in a case where voice communication by the wireless processing unit WU2 is not being performed (ST29, NO), the wireless control section 311 notifies the wireless control section 312 of the wireless processing unit WU2 of voice disconnection through the master device control unit 20 (ST30). Then, in step ST31, the wireless control section 311 responds to the microphone slave device 2C5 with voice disconnection. Thus, voice communication is disconnected between the sub wireless processing unit WU2 and the microphone slave device 2C5.

After voice disconnection, the process of the wireless control section 311 returns to step ST21 and the wireless control section 311 notifies of the control information again at frame intervals, for example, in the next one frame period of the DECT communication.

As described above, in the wireless microphone system 5 of Embodiment 2, the k (k is an even number of 2 or more) wireless processing units WU include (k/2) main wireless processing unit and (k/2) sub wireless processing unit which are paired with each other in one-to-one relationship. The master device control unit 20 generates a communication table 100 such that with respect to the main wireless processing units and the sub wireless processing units which are paired with each other in one-to-one relationship, the number of microphones with which the sub wireless processing units can communicate in the one frame period is larger than the number of microphones with which the main wireless processing units can communicate in the one frame period.

Thus, the main wireless processing unit can also serve as the wireless control of the sub wireless processing unit. That is, as compared with Embodiment 1, the (k/2) main wireless processing unit of the master device 3 are capable of using at least one control channel that is supposed to be used in one frame period by the sub-wireless processing units constituting the same pair together with the main wireless processing units as communication channels. Therefore, the master device 3 can reduce the number of control channels required when the sub wireless processing unit performs wireless control, and the number of communication channels can be increased accordingly. As described above, even if the number of wireless processing units increases, the increase in the number of control channels can be suppressed, so that the decrease in the number of communication channels can be suppressed. Thus, it is possible to increase the number of microphone slave devices that can communicate at the same time.

In addition, the main wireless processing unit constituting the pair performs connection control of voice communication (in other words, communication of a signal relating to connection from the microphone slave device 2) with the corresponding microphone slave device 2 among m microphone slave devices 2. After disconnection control of the voice communication with the corresponding microphone slave device 2 among the m microphone slave devices 2 is performed by the main wireless processing unit constituting a pair together with a sub wireless processing unit, the sub wireless processing unit constituting the pair receives a voice signal from the microphone slave device 2. Thus, the sub wireless processing unit can increase the number of slots allocated to the communication channels by not performing connection control of the voice communication. Thus, it is possible to increase the number of microphone slave devices that can communicate at the same time.

In addition, the main wireless processing unit constituting the pair performs disconnection control of voice communication (in other words, communication of a signal relating to disconnection from the microphone slave device 2) with the corresponding microphone slave device 2 among m microphone slave devices 2. Disconnection control of the voice communication with the corresponding microphone slave device 2 among the m microphone slave devices 2 is performed by the main wireless processing unit constituting a pair together with a sub wireless processing unit, the sub wireless processing unit constituting the pair disconnects voice communication with the microphone slave device 2. Thus, the sub wireless processing unit can increase the number of slots allocated to the communication channels by not performing disconnection control of the voice communication. Thus, it is possible to increase the number of microphone slave devices that can communicate at the same time.

Embodiment 3

In Embodiment 2, the master device 3 has a plurality of pairs of the same number (more specifically, (k/2)) of main wireless processing units and sub wireless processing units, and each of the main wireless processing units also serves as the wireless control of the sub wireless processing unit which forms a pair together with the main wireless processing unit. In Embodiment 3, an example will be described in which the master device 3 includes one main wireless processing unit and (k−1) sub wireless processing units among k wireless processing units WU1 to WUk, and the main wireless processing unit performs the wireless control of all the sub wireless processing units.

The hardware configuration of the wireless microphone system of Embodiment 3 is the same as the hardware configuration of the wireless microphone system of Embodiment 1. The same reference numerals are used for the same constituent elements as those in Embodiment 1, and a description thereof will be omitted.

Figure 15:
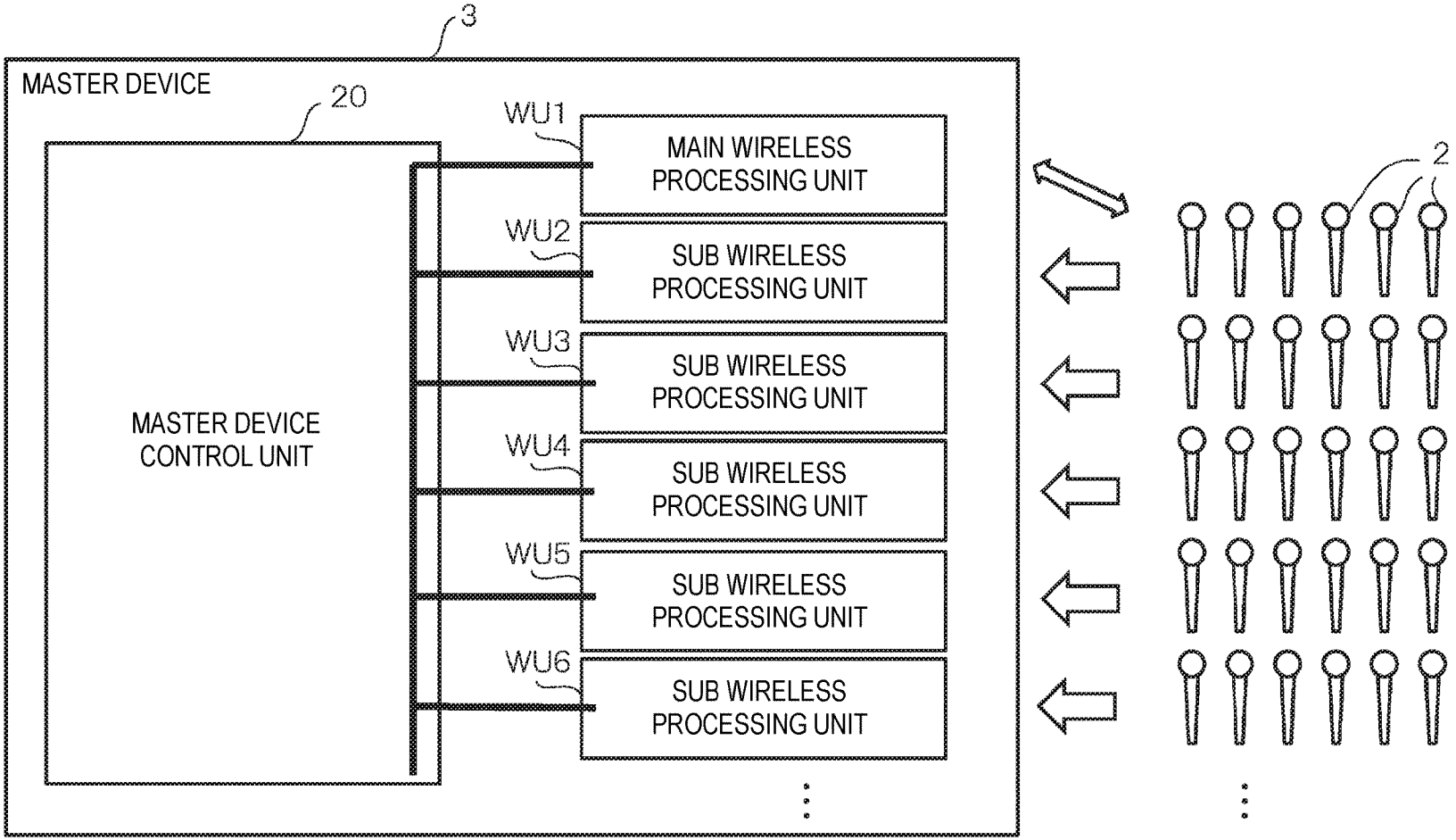
FIG. 15 is a diagram schematically showing a configuration of a portion related to wireless connection of a master device in Embodiment 3.

FIG. 15 is a diagram schematically showing a configuration of a portion related to wireless connection of a master device 3 in Embodiment 3. The plurality of wireless processing units WU is divided into one main wireless processing unit (for example, the wireless processing unit WU1) and (k−1) sub wireless processing units (for example, wireless processing units WU2 to WUk).

Figure 16:
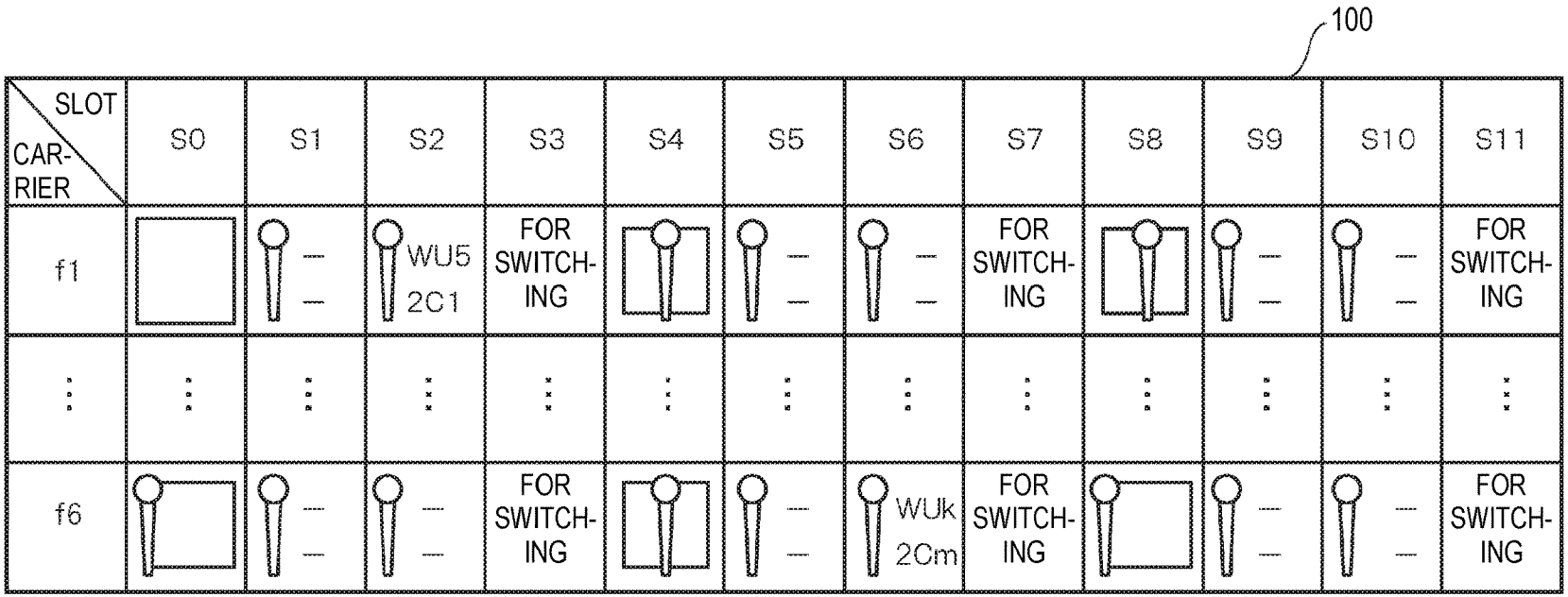
FIG. 16 is a diagram showing an example of registered contents of a communication table showing a communication channel set for each carrier and each slot.

In FIG. 16, the wireless processing unit WU1 substitutes the wireless control of all the wireless processing units WU2 to WUk performing voice communication with each of the plurality of microphone slave devices 2, and the wireless processing unit WU1 itself does not perform voice communication with each of the plurality of microphone slave devices 2. In accordance with the notification from the wireless processing unit WU1, the wireless processing units WU2 to WUk each start voice connection with each of a plurality of microphone slave devices 2 specified based on the communication table 100 and disconnect the voice connection.

FIG. 16 is a diagram showing an example of registered contents of a communication table 100 showing a communication channel set for each carrier and each slot. As in FIG. 7 and FIG. 12, the communication table 100 is stored in the storage unit 25, for example. Each column of the communication table 100 shows twelve slots S0 to S11 in the first half of one frame period in the DECT communication as the time axis. In addition, each row of the communication table 100 indicates the total number of six carriers (carrier waves) used in the DECT communication, as the frequency axis. In FIG. 16, center frequencies f1 to f6 (refer to FIG. 2) of respective carriers (carrier waves) are used to indicate carriers.

As shown in FIG. 16, in the communication table 100, control channels (indicated by rectangles) of the main wireless processing unit (for example, the wireless processing unit WU1), which are allocated for each slot and carrier, and communication channels (indicated by microphones) with the microphone slave device 2, which is communication partner, multiplexed by the sub wireless processing units (for example, the wireless processing units WU2 to WUk) are registered.

The master device control unit 20 monitors the communication status of each slot for each carrier in each frame period of DECT communication, determines the control channel and communication channel to be allocated to each slot of each carrier according to the communication situation, and rewrites the communication table 100 for each frame. For example, in FIG. 16, the master device control unit 20 determines the slot S0 of the carrier of the center frequency f1 as the control channel for notifying all of the microphone slave devices 2 of control information that determines in which slot the main wireless processing unit and the (k−1) sub wireless processing units communicate with which microphone slave device 2 in one frame period. Thereby, as compared with Embodiments 1 and 2, it is not necessary for the master device 3 to allocate at least one control channel to each of all the sub-wireless processing units, so that it is possible to efficiently allocate communication channels in DECT communication to all the sub wireless processing units.

For example, the master device control unit 20 can use the slot S0 of the carrier of the center frequency f6 as the communication channel between which sub wireless processing unit and which microphone slave device 2, in addition to the control channel for notifying of control information.

Similarly, the master device control unit 20 can use the slot S8 of the carrier of the center frequency f6 as the communication channel between which sub wireless processing unit and which microphone slave device 2, in addition to the control channel for notifying of control information.

Further, the master device control unit 20 also determines the slot S4 of the center frequency f1 and the slot S4 of the carrier of the center frequency f6 as the communication channel in the same manner as described above.

Further, similarly to Embodiments 1 and 2, the master device control unit 20 determines slots S1, S2, S4 to S6, S8 to S10, and . . . of the carrier of the center frequency f1 and slots S0 to S2, S4 to S6, and S8 to S10 of the center frequency f6, as communication channels for receiving a voice signal between one of the plurality of sub wireless processing units (for example, the wireless processing units WU2 to WUk) and one of the microphone slave devices 2 specified by the control information.

Similarly to Embodiments 1 and 2, the master device control unit 20 determines each of the slots S3, S7, S11, and . . . of the carrier of the center frequency f1 and the slots S3, S7, and S11 of the carrier of the center frequency f5 to be secured as, for example, free channels for switching and using the same slot as communication channels, instead of communication channels where radio interference is large.

Next, the operation of the wireless microphone system 5 according to the present embodiment will be described.

Figure 17:
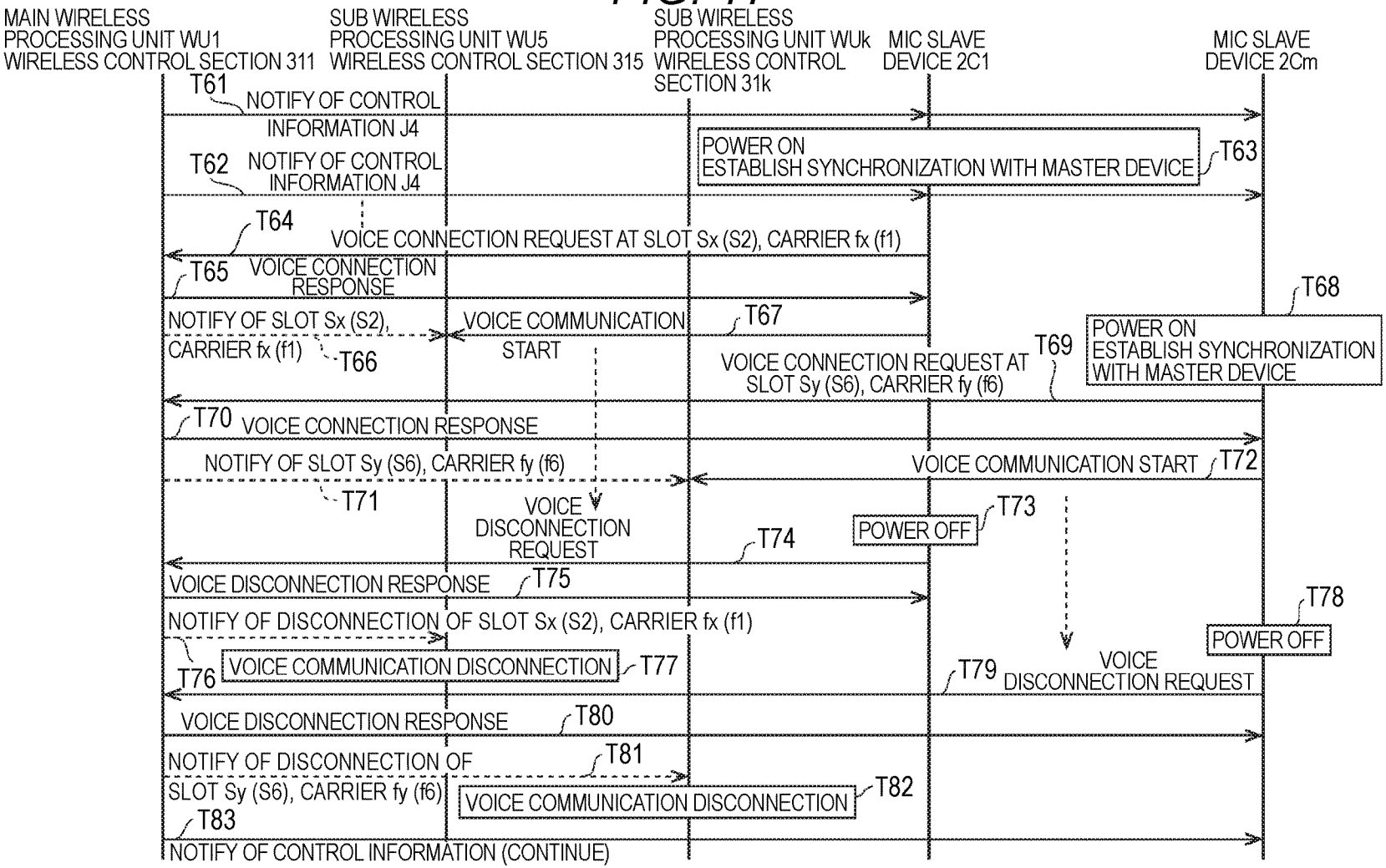
FIG. 17 is a sequence diagram showing an example of a connection procedure of voice communication performed among one main wireless processing unit and a plurality of sub wireless processing units and a plurality of microphone slave devices.

FIG. 17 is a sequence diagram showing an example of a connection procedure of voice communication performed among one main wireless processing unit and a plurality of sub wireless processing units and a plurality of microphone slave devices 2C1 to 2Cm. In FIG. 17, a description will be given by exemplifying main wireless processing unit as the wireless processing unit WU1, and the sub wireless processing units as the wireless processing units WU2 to WUk.

In FIG. 17, before starting the voice communication, the master device control unit 20 acquires identification information of each of all the microphone slave devices 2 capable of voice communication, holds the acquired identification information in the storage unit 25, generates a communication table 100 and stores the table in the storage unit 25. Further, the master device control unit 20 notifies the wireless control section 31 of each wireless processing unit WU of the data of the communication table 100.

The wireless control section 311 of the main wireless processing unit notifies all the microphone slave devices 2 connected to the master device 3 of the control information J4, by using the carrier of the center frequency f1 and the slot S0 (T61). From the viewpoint of the transmission side, the control information J4 is information that determines in which slot the main wireless processing unit (for example, wireless processing unit WU1) and (k−1) sub wireless processing units (for example, wireless processing units WU2 to WUk) of the same pair communicates with which microphone slave device 2 in one frame period, and for further determining which central frequency carrier to be used. In other words, the control information J4 includes the carrier and slot number that the microphone slave device 2 can use as a control channel or a communication channel from the viewpoint of the receiving side. Since both of the microphone slave devices 2C1 to 2Cm are powered off, they cannot receive the control information J4 from the wireless processing unit WU1. Similarly, the wireless processing unit WU1 notifies the microphone slave devices 2C1 to 2Cm that are communication destinations of the control information J4, by using the carrier of the center frequency f1 and the slot S0 again, in the next one frame period of the DECT communication, for example (T62).

When the microphone slave device 2C1 is activated by turning on the power by, for example, a user's operation (T63), it receives the control information J4 from the wireless processing unit WU1. After activation, the microphone slave device 2C1 establishes synchronization for performing communication with the wireless processing unit WU1. The microphone slave device 2C1 requests a voice connection from the wireless processing unit WU1, based on the received control information J4, by using a carrier of an available center frequency fx1 and a slot Sy1 (for example, x1 is any one of integers from 1 to 6 and y1 is any one of integers from 0 to 11 in DECT communication), for example, fx1 (x1=1) and slot Sy1 (y1=2) (T64).

The wireless processing unit WU1 responds to the voice connection request from the microphone slave device 2C1 (T65). The wireless processing unit WU1 notifies the sub wireless processing unit (for example, the wireless processing unit WU5) of the voice connection using the carrier of the center frequency f1 and the slot S2 requested from the microphone slave device 2C1 through the master device control unit 20 (T66).

When the wireless processing unit WU5 is notified of the voice connection using the carrier of the center frequency f1 and the slot S2, voice communication using the carrier of the center frequency f1 and the slot S2 is started between the wireless processing unit WU5 and the microphone slave device 2C1 (T67). When the voice communication is started, the master device 3 can play the voice signal received by the wireless processing unit WU5 with the speaker 29 or outputs it to the mixer receiver 8. The mixer receiver 8 synthesizes the voice signal received by the wireless processing unit WU5 and the voice signal received by the other wireless processing unit and outputs the synthesized voice signal.

On the other hand, when the microphone slave device 2Cm is activated by turning on the power by, for example, a user's operation (T68), it receives the control information J4 from the wireless processing unit WU1. After activation, the microphone slave device 2Cm establishes synchronization for performing communication with the wireless processing unit WU1. The microphone slave device 2Cm requests a voice connection from the wireless processing unit WU1, based on the received control information J4, by using a carrier of an available center frequency fx2 and a slot Sy2 (for example, x1 is any one of integers from 1 to 6 and y1 is any one of integers from 1 to 12 in DECT communication), for example, fx2 (x2=6) and slot Sy2 (y2=6) (T69).

The wireless processing unit WU1 responds to the voice connection request from the microphone slave device 2Cm (T70). The wireless processing unit WU1 notifies the sub wireless processing unit (for example, the wireless processing unit WUk) of the voice connection using the carrier of the center frequency f6 and the slot S6 requested from the microphone slave device 2Cm through the master device control unit 20 (T71).

When the wireless processing unit WUk is notified of the voice connection using the carrier of the center frequency f6 and the slot S6, voice communication using the carrier of the center frequency f6 and the slot S6 is started between the wireless processing unit WUk and the microphone slave device 2Cm (T72). When the voice communication is started, the master device 3 can play the voice signal received by the wireless processing unit WUk with the speaker 29 or outputs it to the mixer receiver 8. The mixer receiver 8 synthesizes the voice signal received by the wireless processing unit WUk and the voice signal received by the other wireless processing unit and outputs the synthesized voice signal.

Thereafter, for example, when the power is turned off by a user operation (T73), the microphone slave device 2C1 requests the wireless processing unit WU1 to disconnect the voice (T74). The wireless processing unit WU1 responds to the voice disconnection from the microphone slave device 2C1 (T75). The wireless processing unit WU1 notifies the wireless processing unit WU5 of the voice disconnection using the carrier of the center frequency f1 and the slot S2 through the master device control unit 20 (T76). The wireless processing unit WU5 disconnects the voice communication with the microphone slave device 2C1 (T77).

Further, for example, when the power is turned off by a user operation (T78), the microphone slave device 2Cm requests the wireless processing unit WU1 to disconnect the voice (T79). The wireless processing unit WU1 responds to voice disconnection from the microphone slave device 2Cm (T80). Further, the wireless processing unit WU1 notifies the wireless processing unit WUk of the voice disconnection using the carrier of the center frequency f6 and the slot S6 through the master device control unit 20 (T81). When receiving the voice disconnection notification from the wireless processing unit WU1, the wireless processing unit WUk disconnects the voice communication with the microphone slave device 2Cm (T82).

When the voice is disconnected between the microphone slave devices 2C1 and 2Cm, the wireless processing unit WU1 continues notification of the control information as in the procedure T61 (T83). Thereafter, the same operation is performed.

Figure 18:
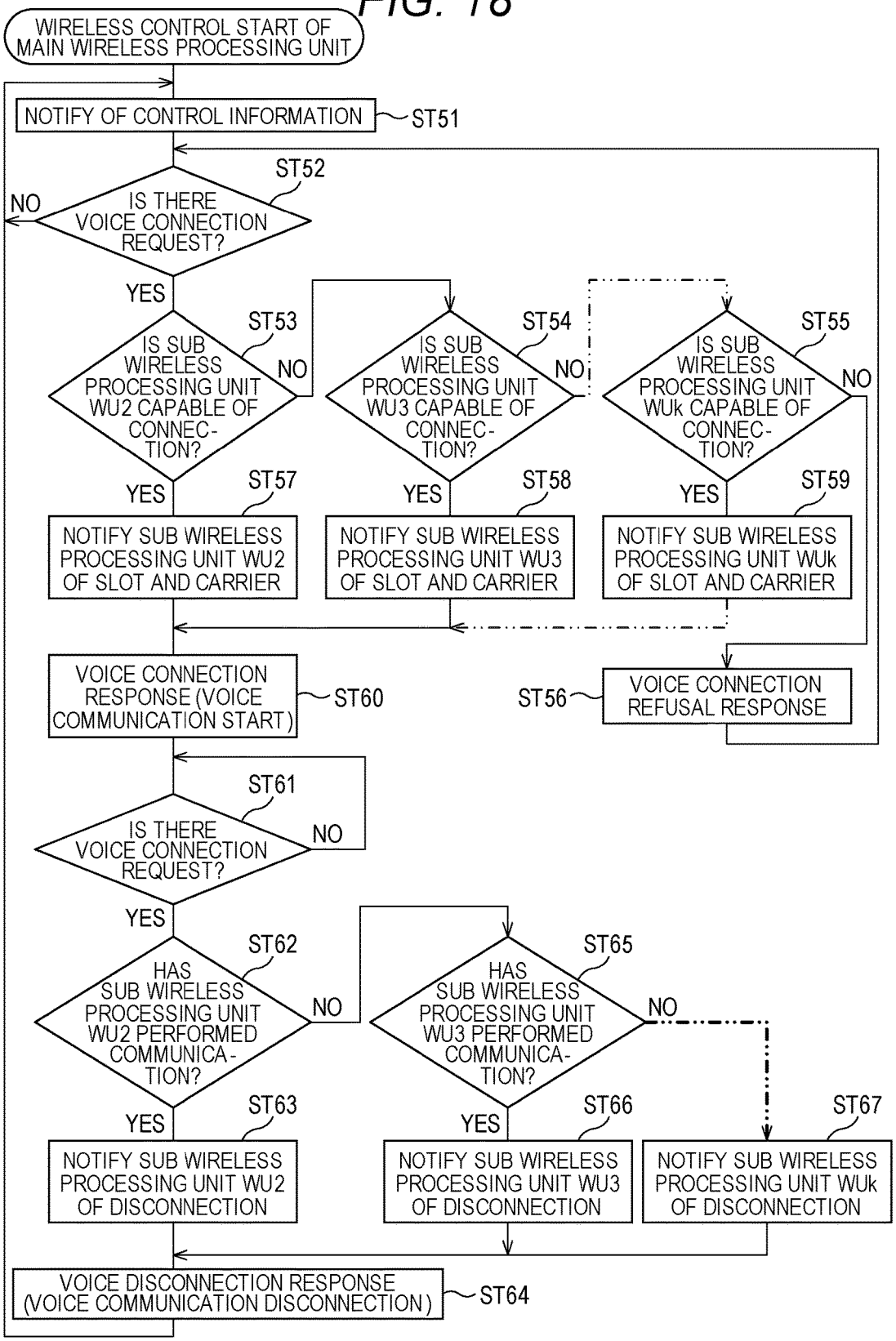
FIG. 18 is a flowchart showing an example of an operation procedure of a wireless control section of the main wireless processing unit of the master device.

FIG. 18 is a flowchart showing an example of an operation procedure of the wireless control section of the main wireless processing unit of the master device 3. As in FIG. 17, the main wireless processing unit is described as the wireless processing unit WU1 and the sub wireless processing units are described as wireless processing units WU2 to WUk. The wireless control section 311 corresponding to the main wireless processing unit notifies all the microphone slave devices 2 of the control information J4 every frame period or every several frame periods of the DECT communication (ST51). After notification of the control information J4, the wireless control section 311 determines whether or not there is a voice connection request from any one of the microphone slave devices 2 (ST52). In a case where there is no connection request (ST52, NO), the process of the wireless control section 311 returns to step ST51, and the wireless control section 311 notifies of the control information J4 again, for example, in the next one frame period of the DECT communication.

On the other hand, when there is a voice connection request from any one of the microphone slave devices 2 (ST52, YES), the wireless control section 311 determines whether or not the sub wireless processing unit (for example, the wireless processing unit WU2) is capable of voice connection, by using the carrier and slot requested by the microphone slave device 2 based on the control information J4 (ST53). When the voice connection cannot be established (ST53, NO), the wireless control section 311 determines whether or not another sub wireless processing unit (for example, the wireless processing unit WU3) is capable of voice connection (ST54). When the voice connection cannot be established in the sub wireless processing unit (ST53, NO), the wireless control section 311 repeats similar determination process and determines whether or not the last sub wireless processing unit WUk is capable of voice connection (ST55).

In a case where the voice connection cannot be established in the last sub wireless processing unit (for example, the wireless processing unit WUk) (ST55, NO), the wireless control section 311 responds to the microphone slave device 2 with a voice connection refusal (ST56). Thereafter, the process of the wireless control section 311 returns to step ST52.

On the other hand, in a case where the sub wireless processing unit (for example, the wireless processing unit WU2) can perform voice connection (ST53, YES), the wireless control section 311 notifies the sub wireless processing unit of the carrier and the slot requested by the microphone slave device 2 (ST57). The wireless control section 311 responds to the microphone slave device 2 with a voice connection (ST60). Thus, voice communication is started between the sub wireless processing unit (for example, the wireless processing unit WU2) and the microphone slave device 2.

Further, in a case where the sub wireless processing unit (for example, the wireless processing unit WU3) can perform voice connection (ST54, YES), the wireless control section 311 notifies the sub wireless processing unit of the carrier and the slot requested by the microphone slave device 2 (ST58). The wireless control section 311 responds to the microphone slave device 2 with a voice connection (ST60). Thus, voice communication is started between the sub wireless processing unit (for example, the wireless processing unit WU3) and the microphone slave device 2.

Similarly, in a case where the sub wireless processing unit (for example, the wireless processing unit WUk) can perform voice connection (ST55, YES), the wireless control section 311 notifies the sub wireless processing unit of the carrier and the slot requested by the microphone slave device 2 (ST59). The wireless control section 311 responds to the microphone slave device 2 with a voice connection (ST60). Thus, voice communication is started between the sub wireless processing unit (for example, the wireless processing unit WUk) and the microphone slave device 2.

Thereafter, the wireless processing unit WU1 determines whether or not there is a voice disconnection request for carriers and slots from the microphone slave device 2 at which voice communication is started (ST61). In a case where there is no voice disconnection request (ST61, NO), the main wireless processing unit (for example, the wireless processing unit WU1) repeats the process of step ST61. Further, in a case where there is a voice disconnection request from the microphone slave device 2 (ST61, YES), the wireless control section 311 determines whether or not voice communication by the sub wireless processing unit (for example, the wireless processing unit WU2) has been performed (ST62). In a case where voice communication by the sub wireless processing unit has been performed (ST62, YES), the wireless control section 311 notifies the sub wireless processing unit of disconnection of voice communication with the microphone slave device 2 (ST 63). The wireless processing unit WU1 responds to the microphone slave device 2 with voice disconnection (ST64). Thereafter, the wireless control section 312 of the wireless processing unit WU2 disconnects the voice communication with the microphone slave device 2.

On the other hand, in a case where the voice communication by the sub wireless processing unit WU2 is not being performed (ST62, NO), the main wireless processing unit (for example, the wireless processing unit WU1) determines whether or not voice communication by another sub wireless processing unit (for example, the wireless processing unit WU3) has been performed (ST65). In a case where voice communication by the sub wireless processing unit has been performed (ST65, YES), the wireless control section 311 notifies the sub wireless processing unit of voice disconnection through the master device control unit 20 (ST66). The wireless control section 311 responds to the microphone slave device 2 with voice disconnection (ST64). Thereafter, the wireless control section 313 of the wireless processing unit WU3 disconnects the voice communication with the microphone slave device 2.

Further, in a case where voice communication by the sub wireless processing unit WU3 is not being performed (ST65, NO), the main wireless processing unit repeats the same determination process as that in steps ST62 and ST65 (that is, a determination process as to whether voice communication by another sub wireless processing unit has been performed). In a case where voice communication by any one of the sub wireless processing units (that is, the wireless processing units WU4 to WUk−1) is not being performed, the wireless control section 311 notifies the sub wireless processing unit WUk of voice disconnection through the master device control unit 20 (ST67). The wireless control section 311 responds to the microphone slave device 2 with voice disconnection (ST64). Thereafter, the wireless control section 31*k* of the wireless processing unit WUk disconnects the voice communication with the microphone slave device 2.

After voice disconnection, the process of the wireless control section 311 returns to step ST51 and the wireless control section 311 notifies of the control information again at frame intervals, for example, in the next one frame period of the DECT communication.

As described above, in the wireless microphone system 5 of Embodiment 3, the k wireless processing units WU include one main wireless processing unit (for example, the wireless processing unit WU1) and (k−1) sub wireless processing units (for example, wireless processing units WU2 to WUk). The master device control unit 20 sets the number of microphone slave devices 2 with which one wireless processing unit WU1 can communicate in one frame period to zero, and the number of microphones with which each of (k−1) sub wireless processing units WU2 to WUk can communicate in one frame period to (n/2).

Thus, in the master device 3, the main wireless processing unit can concentrically control the wireless control with all the microphone slave devices. Therefore, as compared to Embodiments 1 and 2, the master device 3 can further reduce the number of wireless processing units that need wireless control with the microphone slave device 2 and can increase the number of multiplexing at low cost. Further, since the number of main wireless processing units is one, by providing the main wireless processing unit with some functions of the master device control unit 20, the function of the master device control unit 20 specializes in a signal synthesis processing function, so it is possible to realize the master device control unit 20 with an inexpensive field programmable gate array (FPGA) or the like, thereby increasing the number of multiplexing at a lower cost.

One main wireless processing unit WU1 communicates a signal relating to connection from the corresponding microphone slave device 2 among the m microphones. After connection control of the voice communication with the corresponding microphone slave device 2 among the m microphone slave devices 2 is performed by the main wireless processing unit (for example, the wireless processing unit WU1), the (k−1) sub wireless processing units (for example, wireless processing units WU2 to WUk) receives a voice signal from the microphone slave device 2. Thus, the wireless processing units WU2 to WUk can increase the number of slots allocated to the communication channels by not performing connection control of the voice communication. Thus, it is possible to increase the number of microphone slave devices that can communicate at the same time.

One main wireless processing unit WU1 communicates a signal relating to disconnection from the corresponding microphone slave device 2 among the m microphones. After communication of the signal relating to the disconnection with the corresponding microphone slave device 2 among the m microphone slave devices 2 is performed by the main wireless processing unit (for example, the wireless processing unit WU1), the (k−1) sub wireless processing units (for example, wireless processing units WU2 to WUk) disconnects voice communication with the microphone slave device 2. Thus, the wireless processing units WU2 to WUk can increase the number of slots allocated to the communication channels by not performing disconnection control of the voice communication. Thus, it is possible to increase the number of microphone slave devices that can communicate at the same time.

In addition, in Embodiment 3, all the wireless processing units WU1 to WUk included in the master device 3 are divided into one main wireless processing unit and the other sub wireless processing units, but the number of main wireless processing units is not limited to one. For example, k wireless processing units may be divided into some (for example, two to three) main wireless processing units and other (for example, (k−3) to (k−2)) sub wireless processing units.

While various embodiments have been described with reference to the drawings, it is to be understood that the present disclosure is not limited thereto. It is apparent to those skilled in the art that various changes, modifications, substitutions, additions, deletions, and equivalents are conceivable within the scope described in the claims, and It would be appreciated that those naturally belong to the technical scope of the present disclosure. Further, within the scope not deviating from the gist of the invention, respective constituent elements in the above-described various embodiments may be randomly combined.

For example, as described above, in the above-described embodiments, it is described that for the slots S0 to S11 of the first half (for downlink) in the one frame period of the wireless communication of the DECT system, the wireless processing unit and the microphone slave device are associated with the communication channel and the control channel for each carrier and each slot. Similarly, for the slots S12 to S23 of the latter half (for uplink), the wireless processing unit and the microphone slave device may be associated with the communication channel for each carrier and each slot.

Further, in the above-described embodiment s, each wireless processing unit WU receives the communication table 100 from the master device control unit 20 and determines connectable microphone slave device based on the communication table 100, but the master device control unit 20 may control all the wireless processing units WU and connectable microphone slave devices based on the communication table 100.

In the above-described embodiments, DECT with a frequency band of 1.9 GHz is used as a communication system, but without being limited to this frequency band and communication standard, a communication system such as a wireless LAN with a frequency band of 2.4 GHz may be used.

The present disclosure is useful as a communication apparatus, a wireless microphone system, and a communication method in which in a communication system relating to communication performed with microphones which are communication partners, after multiplexing with microphones of the number equal to or larger than a default number of slots constituting one frame period are allowed, communication is performed with each of the microphones, and a voice signal with good voice quality is output.

The present application is based upon Japanese Patent Application (Patent Application No. 2017-251760) filed on Dec. 27, 2017, the contents of which are incorporated herein by reference.

What is claimed is:

1. A communication apparatus comprising:

a controller that generates a table in which a carrier wave and a slot to be used for communication with each of m (m: an integer of 2 or more) microphones are set for each one frame period, based on a default number of carrier waves based on a time division multiplex communication system and n (n: a default positive integer) slots constituting the one frame period of the time division multiplex communication system; and k (k: an integer of 2 or more) wireless processing units that perform communication using the time division multiplex communication system with corresponding individual microphones among the m microphones, based on the generated table, wherein the k wireless processing units respectively operate synchronously based on the same clock signal, and wherein the number C of communicable channels of the m microphones is $C>k*\{(n/2)-1\}$ (*: multiplication operator).

2. The communication apparatus according to claim 1, wherein any one of the k wireless processing units generates the clock signal and supplies the clock signal to the remaining (k−1) wireless processing unit.

3. The communication apparatus according to claim 1, wherein when receiving a voice connection request including information on the carrier wave and the slot, from the corresponding microphone among the m microphones, based on the table, the k wireless processing units start communication with the microphone.

4. The communication apparatus according to claim 3, wherein when receiving a voice disconnection request from the corresponding microphone among the m microphones that perform communication, the k wireless processing units terminate communication with the microphone.

5. The communication apparatus according to claim 1, wherein k is an even number of 2 or more, wherein the k wireless processing units include (k/2) main wireless processing unit and (k/2) sub wireless processing unit which are paired with each other in one-to-one relationship, and wherein the controller generates a table such that with respect to the main wireless processing units and the sub wireless processing units which are paired with each other in one-to-one relationship, the number of microphones with which the sub wireless processing units can communicate in the one frame period is larger than the number of microphones with which the main wireless processing units can communicate in the one frame period.

6. The communication apparatus according to claim 5, wherein the main wireless processing unit constituting the pair performs communication of a signal relating to connection from the corresponding microphone among the m microphones, and wherein after communication of the signal relating to the connection with the corresponding microphone among the m microphones is performed by the main wireless processing unit constituting the pair together with the sub wireless processing unit, the sub wireless processing unit constituting the pair receives a voice signal from the microphone.

7. The communication apparatus according to claim 5, wherein the main wireless processing unit constituting the pair performs communication of a signal relating to disconnection from the corresponding microphone among the m microphones, and wherein after communication of the signal relating to the disconnection with the corresponding microphone among the m microphones is performed by the main wireless processing unit constituting the pair together with the sub wireless processing unit, the sub wireless processing unit constituting the pair disconnects voice communication with the microphone.

8. The communication apparatus according to claim 1, wherein the k wireless processing units include one main wireless processing unit and (k−1) sub wireless processing units, and wherein the controller sets the number of microphones with which the one main wireless processing unit can communicate in the one frame period to zero, and the number of microphones with which each of the (k−1) sub wireless processing units can communicate in the one frame period to (n/2).

9. The communication apparatus according to claim 7, wherein the one main wireless processing unit performs communication of a signal relating to connection from the corresponding microphone among the m microphones, and wherein after communication of the signal relating to the connection with the corresponding microphone among the m microphones is performed by the main wireless processing unit, the (k−1) sub wireless processing units receive a voice signal from the microphone.

10. The communication apparatus according to claim 7, wherein the one main wireless processing unit performs communication of a signal relating to disconnection from the corresponding microphone among the m microphones, and wherein after communication of the signal relating to the disconnection with the corresponding microphone among the m microphones is performed by the main wireless processing unit, the (k−1) sub wireless processing units disconnect the voice communication with the microphone.

11. A wireless microphone system comprising:

a master device; and m (m: an integer of 2 or more) microphones which are connected to the master device for communication, wherein the master device includes a controller that generates a table in which a carrier wave and a slot to be used for communication with each of the m microphones are set for each one frame period, based on a default number of carrier waves based on a time division multiplex communication system and n (n: a default positive integer) slots constituting the one frame period of the time division multiplex communication system; and k (k: an integer of 2 or more) wireless processing units that perform communication using the time division multiplex communication system with corresponding individual microphones among the m microphones, based on the generated table, wherein the k wireless processing units respectively operate synchronously based on the same clock signal, and wherein the number C of communicable channels of the m microphones is $C>k*\{(n/2)-1\}$ (*: multiplication operator).

12. A communication method using a communication apparatus connected to m (m: an integer of 2 or more) microphones for communication, the method comprising:

generating a table in which a carrier wave and a slot to be used for communication with each of the m microphones are set for each one frame period, based on a default number of carrier waves based on a time division multiplex communication system and n (n: a default positive integer) slots constituting the one frame period of the time division multiplex communication system; and performing communication using the time division multiplex communication system with corresponding individual microphones among the m microphones, based on the generated table, by k (k: an integer of 2 or more) wireless processing units included in the communication apparatus, wherein the performing communication by the k wireless processing units has steps of respectively operating synchronously based on the same clock signal, and wherein the number C of communicable channels of the m microphones is $C>k*\{(n/2)-1\}$ (*: multiplication operator).

* * * * *